US010453661B2

(12) United States Patent
Arai

(10) Patent No.: US 10,453,661 B2
(45) Date of Patent: *Oct. 22, 2019

(54) ION FILTER AND METHOD OF MANUFACTURING ION FILTER

(71) Applicant: FUJIKURA LTD., Tokyo (JP)

(72) Inventor: Daisuke Arai, Chiba (JP)

(73) Assignee: FUJIKURA LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/781,018

(22) PCT Filed: Dec. 2, 2016

(86) PCT No.: PCT/JP2016/085947

§ 371 (c)(1),
(2) Date: Jun. 1, 2018

(87) PCT Pub. No.: WO2017/094896

PCT Pub. Date: Jun. 8, 2017

(65) Prior Publication Data

US 2018/0358214 A1 Dec. 13, 2018

(30) Foreign Application Priority Data

Dec. 2, 2015 (JP) ..... 2015-235481

(51) Int. Cl.
*H01J 47/00* (2006.01)
*H01J 47/06* (2006.01)

(52) U.S. Cl.
CPC ..... *H01J 47/008* (2013.01); *H01J 47/06* (2013.01)

(58) Field of Classification Search
CPC .. H01J 47/008; H01J 47/06; H01J 1/46; H01J 9/14; H01J 47/00

(Continued)

(56) References Cited

U.S. PATENT DOCUMENTS 6,011,265 A * 1/2000 Sauli ..... H01J 47/02 250/374
6,198,798 B1 3/2001 Sauli (Continued)

FOREIGN PATENT DOCUMENTS

CN 1039930 A 2/1990
CN 101036213 A 9/2007

(Continued)

OTHER PUBLICATIONS

F. Sauli et al., "Ion feedback suppression in time projection chambers" Nuclear Instruments and Methods in Physics Research A 560, pp. 269-277, 2006 (9 pages).

(Continued)

*Primary Examiner* — David P Porta
*Assistant Examiner* — Meenakshi S Sahu
(74) *Attorney, Agent, or Firm* — Osha Liang LLP

(57) ABSTRACT

An ion filter is used for a gas detector including a gas electron multiplier. The ion filter includes: an insulating substrate; a first patterned conductive layer on one main surface of the insulating substrate; and a second patterned conductive layer on another main surface of the insulating substrate. The ion filter has a plurality of through-holes formed along a thickness direction of the insulating substrate on which the first patterned conductive layer and the second patterned conductive layer are formed. The one main surface of the insulating substrate is disposed on an upstream side in a movement direction of electrons in the gas detector. The other main surface of the insulating substrate is disposed on a downstream side in the movement direction of the electrons in the gas detector. The first patterned conductive layer has a line width thicker than a line width of the second patterned conductive layer.

9 Claims, 16 Drawing Sheets

(58) Field of Classification Search
USPC ..... 250/379
See application file for complete search history.

(56) References Cited

U.S. PATENT DOCUMENTS

| | | | | |
|---|---|---|---|---|
| 6,429,578 | B1 | 8/2002 | Danielsson et al. | |
| 10,037,860 | B2 * | 7/2018 | Arai | G01T 1/18 |
| 2002/0149305 | A1 | 10/2002 | Danielsson et al. | |
| 2004/0258206 | A1 * | 12/2004 | Maolinbay | H01J 47/02 378/98.8 |
| 2009/0084972 | A1 | 4/2009 | Tamagawa et al. | |
| 2011/0089042 | A1 | 4/2011 | De Oliveira et al. | |

FOREIGN PATENT DOCUMENTS

| | | | |
|---|---|---|---|
| CN | 104342632 | A | 2/2015 |
| CN | 107078017 | A | 8/2017 |
| EP | 0948803 | A1 | 10/1999 |
| JP | 2001-508935 | A | 7/2001 |
| JP | 2007-234485 | A | 9/2007 |
| JP | 2011-517050 | A | 5/2011 |
| JP | 2016-062736 | A | 4/2016 |
| WO | 01/59478 | A1 | 8/2001 |
| WO | 2009/127220 | A1 | 10/2009 |

OTHER PUBLICATIONS

Xie Wen-Qing et al., "Electron transmission efficiency of gating-GEM foil for TPC" Chinese Physics C, vol. 36, No. 4, pp. 339-343, Apr. 2012 (5 pages).

P. Gros et al., "Blocking positive ion backflow using a GEM gate: experiment and simulations", 3rd International Conference on Micro Pattern Gaseous Detectors, Jul. 1, 2013 through Jul. 6, 2013; Journal of Instrumentation, Impact Factor: 1.4, Nov. 2013 (11 pages).

Everaerts, Pieter, "Rate Capability and Ion Feedback in Gem-Detectors", Academiejaar 2005-2006, Faculteit Ingenierswetenschappen, Universiteit Gent [online], 2006 [retrieval date Feb. 13, 2017], Internet: <URL: https://cds.cern.ch/record/1316179/files/CERN-THESIS-2006-088.pdf>, pp. 52-75 (27 pages).

Office Action issued in corresponding Korean Application No. 10-2018-7005639 dated Nov. 15, 2018 (10 pages).

Lyashenko, A. V. et al., "Advances in ion back-flow reduction in cascaded gaseous electron multipliers incorporating R-MHSP elements," Institute of Physics Publishing and SISSA, dated Oct. 20, 2006 (17 pages).

Extended European Search Report issued in corresponding European Patent Application 168708311 dated Jun. 5, 2019 (10 pages).

Marco Villa et al., "Progress on large area GEMs (VCI 2010)", arxiv.org, Cornell University Library, 201 Olin Library Cornell University Ithaca, NY 14853, Jul. 7, 2010, XP080487222 (4 pages).

* cited by examiner

ION FILTER AND METHOD OF MANUFACTURING ION FILTER

TECHNICAL FIELD

The present invention relates to an ion filter used for a gas detector comprising a gas electron multiplier and a method of manufacturing an ion filter.

BACKGROUND ART

Gas detectors are known as one type of radiation detectors. With regard to such gas detectors, a gas detector is known in which a gas electron multiplier is used as the gas electron multiplying section (Patent Document 1).

CITATION LIST

Patent Document

Patent Document 1 JP2007-234485A

Non-Patent Document

[Non-Patent Document 1] Sauli F et al., Ion feedback suppression in time projection chambers: Nuclear Instruments and Methods in Physics A, 2006, 560(2): 269-277.

[Non-Patent Document 2] XIE Wen-Qing et al., Electron transmission efficiency of gating-GEM foil for TPC: Chinese Physics C, 2012, Vol.36 No.4, pp.339-343.

[Non-Patent Document 3] P. Gros et al., Blocking positive ion backflow using a GEM GATE: experiment and simulations: 3rd INTERNATIONAL CONFERENCE ON MICRO PATTERN GASEOUS DETECTORS 1-6 Jul., 2013, Journal of Instrumentation, November 2013, Impact Factor: 1.4. doi: 10.1088/1748-0221/8/11/C11023.

Gas detectors of this type are configured to receive radiation to be detected, multiply electrons by the avalanche effect using a gas electron multiplier having a large number of through-holes, and detect its electric signal. Electrons are emitted from gas atoms by the photoelectric effect of radiation and a gas.

Multiplication of a number of electrons generates the same number of positive ions. The generated positive ions proceed in the opposite direction to the movement direction of electrons because the positive ions are affected by electric fields in the through-holes provided in the gas electron multiplier.

Since the moving speed of positive ions having a relatively large mass is slower than the moving speed of electrons, the positive ions gather and remain inside the gas detector so as to form a shape depending on the shape of the gas electron multiplier, which may generate an electric field. For example, an electron multiplier foil is used as the gas electron multiplier, the positive ions gather in a flat plate-like shape, which is the shape of the electron multiplier foil, to generate an electric field. The electric field generated by the positive ions changes the movement direction of electrons to be measured by the gas detector.

Thus, the electric field generated by the positive ions causes a so-called positive-ion matter of deteriorating the position resolution of the gas detector in which the gas electron multiplier is used.

To resolve this positive-ion matter, a conventional scheme of using wire electrodes is known in which the wire electrodes are arranged on the upstream side in the gas detector such that the electric fields generated from the wire electrodes prevent the positive ions from feeding back. When the wire electrodes are used under a high magnetic field, however, another matter occurs in that the E×B effect takes place in the vicinity of the wire electrodes to distort the trajectories of moving electrons near the wire electrodes. In addition, if even the movement of electrons is blocked due to the E×B effect when preventing the positive ions from feeding back, the position resolution will deteriorate, which may also become a matter to be resolved.

Thus, the existing challenge is to contrive to prevent positive ions from feeding back while suppressing the reduction in transmittance of electrons to be measured.

Non-Patent Document 1 (issued in 2006), item 2 of the left column on page 270, refers to the positive-ion matter. The third paragraph of the left column on page 270 of the document discloses a matter of using a wire as the "Ion Gate." The second line from the bottom of the left column on page 272 of the document to line 4 of the right column describe operating the first-stage (uppermost-stream) electron multiplier (GEM) of the electron multipliers (GEMs) by applying a low voltage (about 10 V) under the recognition of a reduced ion transmittance.

Non-patent document 2 (issued in 2012) refers to the ion feedback in TPC in Abstract on page 339. Item 2.1 of the right column on page 340 of the document and FIG. 5 on page 342 of the document describe a "Gating GEM" to which a low voltage of about 10 V is applied.

Non-patent document 3 (issued in 2013) refers to suppression of the positive-ion feedback using a "GEM GATE." ABSTRACT of the document discloses that the GEM was used as a gating device in Non-Patent Document 1. FIG. 2 on the second page of the document illustrates the ion transmittance when the voltage of the GEM GATE is 10 V. According to FIG. 6 on page 5 of the document, discussion is made to a case in which the voltage of the GEM is 20 V or less.

SUMMARY

One or more embodiments of the present invention provide an ion filter that prevents positive ions from feeding back while suppressing the reduction in transmittance of electrons to be measured and provide a method of manufacturing such an ion filter.

(1) One or more embodiments of the present invention provide an ion filter used for a gas detector comprising a gas electron multiplier. The ion filter comprises an insulating substrate, a first conductive layer pattern formed on one main surface of the insulating substrate, and a second conductive layer pattern formed on the other main surface of the insulating substrate. The ion filter has a plurality of through-holes formed along the thickness direction of the insulating substrate on which the first conductive layer pattern and the second conductive layer pattern are formed. The one main surface of the insulating substrate is disposed on the upstream side in the movement direction of electrons in the gas detector. The other main surface of the insulating substrate is disposed on the downstream side in the movement direction of electrons in the gas detector. The first conductive layer pattern has a line width thicker than the line width of the second conductive layer pattern.

(2) In the aforementioned embodiments, the line width of the first conductive layer pattern formed on the one main surface of the insulating substrate is 10 [μm] or more and 40 [μm] or less and the line width of the second conductive layer pattern formed on the other main surface of the insulating substrate is 0.4 times or more and 0.9 times or less the line width of the first conductive layer pattern.

(3) In one or more embodiments, the ion filter is configured such that the area of a first aperture of each through-hole on the first conductive layer pattern side is smaller than the area of a second aperture of the through-hole on the second conductive layer pattern side and an inner surface that forms the through-hole on the second conductive layer pattern side has an angle of 40 degrees or more and 70 degrees or less with respect to the main surfaces of the insulating substrate.

(4) In one or more embodiments, the ion filter is configured such that the ion filter is provided together with the gas electron multiplier in a side-by-side fashion and the other main surface side of the insulating substrate is disposed on the gas electron multiplier side.

(5) In one or more embodiments, the ion filter is configured such that the through-holes have a hole-area ratio of 70% or more. The hole-area ratio is a ratio of the total area of apertures formed by the through-holes to a predetermined unit area along the main surfaces of the insulating substrate.

(6) One or more embodiments of the present invention provide a method of manufacturing an ion filter. The method comprises preparing a substrate comprising an insulating substrate, a first conductive layer formed on one main surface of the insulating substrate, and a second conductive layer formed on the other main surface of the insulating substrate, making an etching liquid act on a second predetermined region of the second conductive layer to remove the second predetermined region thereby to form a second conductive layer pattern having a predetermined second line width, irradiating a formation region of the second conductive layer pattern and an outside region of an end part of the second conductive layer pattern with laser from the other main surface side, and making an etching liquid act on the first conductive layer at least from the other main surface side thereby to remove a first predetermined region to form a first conductive layer pattern having a predetermined first line width thicker than the second line width and remove the first conductive layer in the outside region of the end part.

According to one or more embodiments of the present invention, an ion filter can be provided which prevents positive ions from feeding back while suppressing the reduction in transmittance of electrons to be measured.

DETAILED DESCRIPTION OF EMBODIMENTS

Hereinafter, embodiments of the present invention will be described with reference to the drawings. In one or more embodiments of the present invention, the ion filter is applied to a central drift chamber, which is one of measurement units that constitute an international large detector (ILD) measurement device. The ILD measurement device according to one or more embodiments of the present invention comprises at least a central drift chamber. In one or more embodiments of the present invention, a gas detector can be used as the central drift chamber. More specifically, in one or more embodiments of the present invention, a time projection chamber (TPC) 100 is used as a gas detector 100. The TPC 100 according to one or more embodiments of the present invention measures trajectories of radiation including charged particles under a predetermined high magnetic field and measures the positions and momenta of the particles from the trajectories of radiation. The ILD according to one or more embodiments of the present invention requires a central drift chamber, and the gas detector 100 is applied to the central drift chamber. The electron multiplying section of the gas detector 100 is provided with a gas electron multiplier 2 (GEM: gas multiplier foil 2), and an ion filter is provided together with the gas electron multiplier 2 (GEM: gas multiplier foil 2) in a side-by-side fashion.

Figure 1:
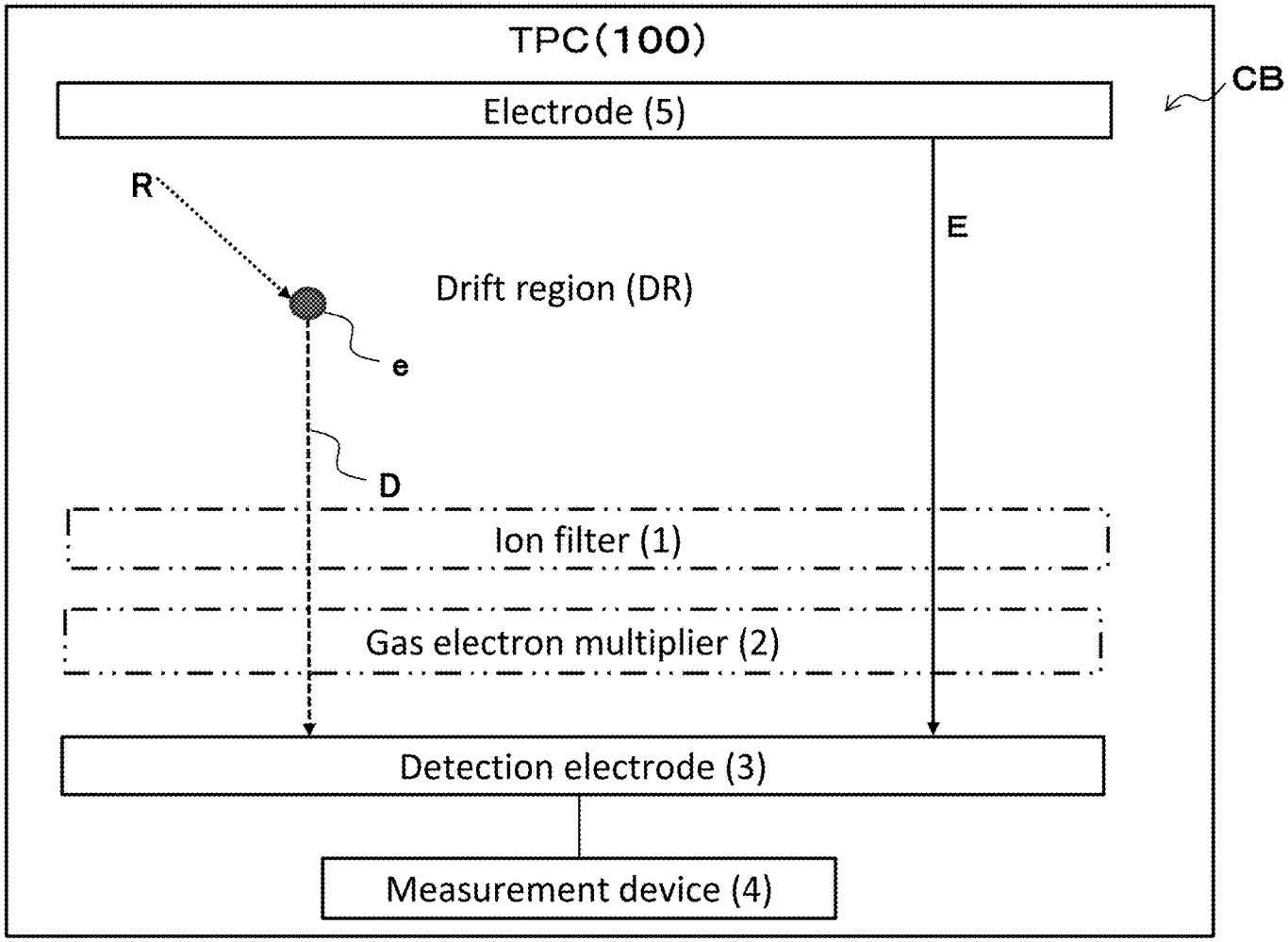
FIG. 1 is a schematic view of a gas detector according to one or more embodiments of the present invention.

FIG. 1 is a schematic view of the time projection chamber (TPC) 100 as an example of the central drift chamber in which the gas detector according to one or more embodiments of the present invention is used. As illustrated in FIG. 1, the TPC 100 according to one or more embodiments of the present invention comprises an ion filter 1, a gas electron multiplier 2, a detection electrode 3, a measurement device 4, an electrode 5, a space to be a drift region DR, and a chamber CB. The drift region DR is formed in the chamber CB. In the TPC 100 according to one or more embodiments of the present invention, when charged particles are made to enter the chamber filled with a gas for detection, the gas molecules in the chamber are ionized due to the photoelectric effect with the gas atoms generated when the charged particles pass through the gas. The gas molecules ionized by the charged particles emit electrons. The TPC 100 detects an electric signal caused by electrons generated when the gas molecules in the chamber are ionized. Ionization of the gas molecules in the chamber, that is, emission of electrons, takes place along the trajectories of radiation (including charged particles, here and hereinafter) entering the drift region DR. The gas detector successively detects the positions of electrons thereby to track the two-dimensional trajectories of the charged particles. In other words, primary electrons are generated due to the photoelectric effect of radiation and gas generated when the charged particles enter the chamber, and when the primary electrons reach the gas electron multiplier 2 (e.g. electron multiplier foil 2) by the electric field, the primary electrons are multiplied to emit secondary electrons. The gas detector successively detects the positions of the secondary electrons thereby to track the trajectories of radiation. In addition, the TPC 100 according to one or more embodiments of the present invention includes a drift region that drifts the primary electrons released from gas atoms due to the photoelectric effect of radiation and gas, and measures not only the two-dimensional positions but also the three-dimensional positions of the trajectories of radiation.

Furthermore, the TPC according to one or more embodiments of the present invention calculates the three-dimensional trajectories, which includes the Z-axis direction, using the particle drift time in the drift region DR. That is, the TPC according to one or more embodiments of the present invention is a gas detector having a three-dimensional trajectory detection function.

The gas electron multiplier 2 according to one or more embodiments of the present invention multiplies the electrons, which are generated when the gas molecules are ionized due to the photoelectric effect of the radiation including the charged particles and the gas molecules, using the electron avalanche effect in the high electric field. Thus, the electrons are multiplied and it is thereby possible to accurately detect the electric signal caused by electrons generated when the gas atoms are ionized. The detection electrode 3 accurately detects the electric signal. The detection electrode 3 outputs the detected electric signal to the measurement device 4.

Using the detection signal acquired from the detection electrode 3, the measurement device 4 measures the trajectories (changes in positions over time) of the charged particles entering. That is, the measurement device 4 measures the positions at which the charged particles pass through the TPC 100. The measurement device 4 outputs the measurement result of the trajectories of charged particles entering the TPC 100 to the outside. Measurement data on the positions of charged particles entering the TPC 100 is used for the international linear collider (ILC) experiment. In the ILC experiment, measured values obtained from a plurality of measurement units including a gas detector such as the TPC 100 are integrated to confirm the existence of particles to be observed or to measure the properties of particles to be observed.

The TPC 100 using the gas detector according to one or more embodiments of the present invention comprises at least the ion filter 1, the gas electron multiplier 2, and the detection electrode 3. The TPC 100 according to one or more embodiments of the present invention includes the chamber CB. In the chamber CB of the TPC 100 of this example, the ion filter 1, the gas electron multiplier 2, the detection electrode 3, and the electrode 5 are provided. The chamber CB has the drift region DR therein which is a space through which the charged particles move. One or more power sources (not illustrated) supply electric power to them. The TPC 100 according to one or more embodiments of the present invention includes the measurement device 4. The measurement device 4 acquires a detection signal from the detection electrode 3.

Each configuration will be described below.

The chamber CB forms a space filled with a gas for detection. A combination of a rare gas and a quencher gas is generally used as the gas for detection which fills the chamber CB. Examples of the rare gas include He, Ne, Ar, and Xe. Examples of the quencher gas include $CO_2$, $CH_4$, $C_2H_6$, $CF_4$, and $C_4H_{10}$. The mixing ratio of the quencher gas mixed to the rare gas may be, but is not limited to being, 5% to 30%.

The electrode 5 forms an electric field in the chamber CB. Ionized electrons, which are released from the gas atoms by the interaction due to the photoelectric effect of radiation and the gas, drift and move in the electric field toward the detection electrode 3 which serves as an anode. In addition to the electrode 5, an electrode (not illustrated) for forming an electric field may be provided on the inner side surface of the chamber CB from the viewpoint of improving the accuracy of position resolution of particles in the TPC 100. The electrode for forming an electric field may comprise a plurality of electrodes provided along the movement direction of electrons in the drift region. By providing such an electrode or electrodes for forming an electric field in the drift region, the electrons can be drifted and moved along the direction toward the detection electrode 3. The electrode or electrodes for forming an electric field provided on the inner side surface of the chamber CB suppress the disturbance of the electric field in the drift region and keeps the electric field uniform. This can prevent distortion of the trajectories of electrons due to the disturbed electric field when the electrons are drifted and moved.

In particular, when the length of the drift region (length along the movement direction of electrons) is long as in the ILC-TPC, the uniformity of the electric field in the drift region tends to be disturbed (the uniformity tends to be disrupted). Even in such a case, the electrode or electrodes for forming an electric field are provided in the drift region in addition to the electrode 5 and it is thereby possible to suppress the disturbance of the electric field in the drift region and keep the electric field uniform.

The gas electron multiplier 2 is a type of micro pattern gas detectors (MPGD) that multiply electrons.

The electron multiplier foil 2 as the gas electron multiplier 2 according to one or more embodiments of the present invention is formed such that both main surfaces of a sheet-like insulating substrate are formed with conductive layers, such as copper layers, and has a large number of through-holes. The through-holes of the gas electron multiplier 2 extend approximately in the perpendicular direction to the main surfaces of the insulating substrate. An electric potential difference of several hundred volts is applied between the conductive layers, which are formed on both main surfaces of the insulating substrate, thereby to form high electric fields inside the through-holes. Electrons entering the through-holes are immediately accelerated. The accelerated electrons ionize the surrounding gas molecules, so that electrons are multiplied in avalanche inside the through-holes (avalanche effect). As is known in the art, the gas electron multiplier 2 may be abbreviated as GEM.

The thickness of the electron multiplier foil 2 may be, but is not limited to being, about several hundred micrometers. Well-known examples of the diameter and pitch of the through-holes are about 70 [μm] and 140 [μm], respectively. The hole-area ratio of the through-holes of the electron multiplier foil 2 may be about 23%. The hole-area ratio is a ratio of the total area of apertures formed by the through-holes of the electron multiplier foil 2 to a predetermined unit area along the main surfaces of the insulating substrate. A polymer material, such as polyimide and liquid crystal polymer, for example, may be used as the material of the insulating substrate which constitutes the electron multiplier foil 2. Copper, aluminum, gold, or boron, for example, may be used as the material of the conductive layers which constitute the electron multiplier foil 2. The conductive layers of the electron multiplier foil 2 may be formed through vapor deposition of the conductive material on the insulating substrate by sputtering, may be formed using a plating process, or may be formed using a lamination process.

The detection electrode 3 detects electrons that are multiplied by the avalanche effect and sends the detection signal to the measurement device 4. The measurement device 4 calculates various detection data on the basis of the acquired signal from the detection electrode 3. Although not particularly limited, the detection data may be used for measurement of the trajectories of charged particles, measurement of the positions and momenta of charged particles, and other purposes.

An electron e generated when the gas molecules are ionized due to the photoelectric effect of radiation and gas drifts and moves along a direction D indicated by the arrow in the chamber CB. The direction D is a direction along the movement direction E of electrons from the electrode 5 to the detection electrode 3. In the movement direction E of electrons, one side provided with the electrode 5 is the upstream side while the other side provided with the detection electrode 3 is the downstream side.

The ion filter 1 according to one or more embodiments of the present invention will then be described.

As previously described, the multiplication of a number of electrons by ionization of the gas generates the same number of positive ions. There are positive ions, among the generated positive ions, which pass through middle areas of the through-holes of the gas electron multiplier 2 to move (feed back) to the drift region DR.

Since the drift speed of positive ions is slow, the fed-back positive ions remain, for example, as a plate-like cloud in the drift region DR for a long time so as to form a site in the drift region DR in which the ion density is locally high. This will distort the electric field in the drift region DR. When a magnetic field exists in the chamber, the drifting electrons may undergo the E×B effect to deteriorate the position resolution. In particular, the ILC-TPC, that is, the TPC 100 according to one or more embodiments of the present invention, has a relatively long drift region along the traveling direction E of electrons in accordance with the requirement in the ILC experiment. Accordingly, the electric field in the drift region DR is distorted by the positive ions flowing backward into the drift region, and the position resolution of particles tends to deteriorate. As will be understood, the ILC experiment requires not merely to measure the three-dimensional positions of particles but also to measure the three-dimensional positions of various particles that are expected to be generated. In accordance with the type of particles that are expected to be generated, the length of the drift distance required for the three-dimensional position measurement of the particles is the length of the drift region which should be provided in the structure of the ILC-TPC. The TPC 100 is therefore provided with a relatively long drift region along the traveling direction E of electrons.

The ion filter 1 according to one or more embodiments of the present invention has a function of collecting the generated positive ions due to the electron multiplication so that the positive ions do not move toward the drift region DR (in the opposite direction to the movement direction E of electrons).

The ion filter 1 according to one or more embodiments of the present invention comprises a three-layer structure having an insulating substrate, a first conductive layer formed on one main surface of the insulating substrate, and a second conductive layer formed on the other main surface of the insulating substrate. The ion filter 1 has a plurality of through-holes formed along the thickness direction of the insulating substrate.

In some related art, a member having a function of suppressing the positive-ion feedback may be referred to as a "GEM GATE" using the term "GEM" which represents the gas multiplier foil 2. However, the "GEM" has a function of causing the electron avalanche effect by applying a high voltage while the "GEM GATE" has a function of capturing the fed-back positive ions by applying a low voltage, and both are devices with different technical meanings.

The "GEM GATE" and the "ion filter" may have a common aspect only in that they can be used for the purpose of capturing fed-back ions, but their specific structures are completely different.

The ion filter and the GEM are common with electron multipliers (GEM) in an aspect that they are in a "three-layer structure" in which conductive layers are provided on both surfaces of an insulating substrate, but their specific forms are significantly different.

Table 1 lists the differences in the basic structures of the electron multiplier (GEM) and the ion filter.

TABLE 1

| | GEM | Ion filter |
|---|---|---|
| Structure | Three-layer structure | Three-layer structure |
| Thickness (each) | 50 [μm] or more | 25 [μm] or less |
| Aperture diameter | ≈70 [μm] | 140 [μm] or more to 300 [μm] or less |
| Rim width/Pitch | ≈140 [μm] | 45 [μm] or less |
| Hole-area ratio | ≈23% | 70% or more |

As listed in Table 1, the ion filter has a smaller thickness, a larger aperture diameter, and a larger hole-area ratio than those of the GEM. When the ion filter in such a form is used as a GEM, the ion filter cannot serve as a GEM because it cannot withstand the applied high voltage (may be destroyed) due to its thinness and narrow line width. In the first place, in the ion filter 1 having a thickness of 25 μm or less, the high electric field region formed in each through-hole is small, and the ion filter therefore cannot multiply electrons in theory. On the other hand, when the GEM in such a form of Table 1 is used as an ion filter, it is difficult to suppress the passage of electrons to be measured and maintain sufficient detection accuracy because of the thickness and the small hole-area ratio.

Figure 2A:
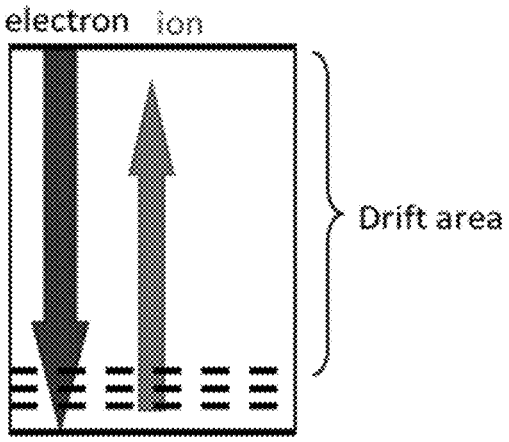
FIG. 2A is a first view for describing the function of an ion filter according to one or more embodiments of the present invention.
Figure 2B:
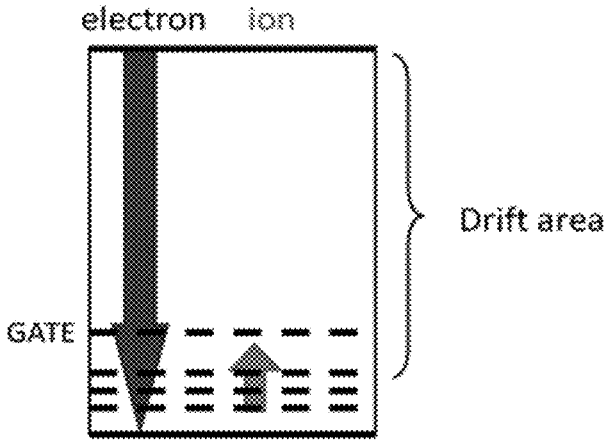
FIG. 2B is a second view for describing the function of the ion filter according to one or more embodiments of the present invention.

The functions of the ion filter 1 having the above configuration will be described with reference to FIGS. 2A and 2B and FIGS. 3A and 3B. The ion filter 1 according to one or more embodiments of the present invention has a three-layer structure. As illustrated in FIG. 2A, therefore, the ion filter 1 blocks (captures) the fed-back positive ions by inverting the voltage applied between the first conductive layer and the second conductive layer formed on both surfaces of the insulating substrate. As illustrated in FIG. 2B, the ion filter 1 is provided in the drift region and a low voltage (relatively low voltage, e.g., about 5 V to 20 V) is applied to the ion filter 1, which thereby serves as a gate that allows the electrons to transmit to generate a signal and blocks the fed-back ions.

Figure 3A:
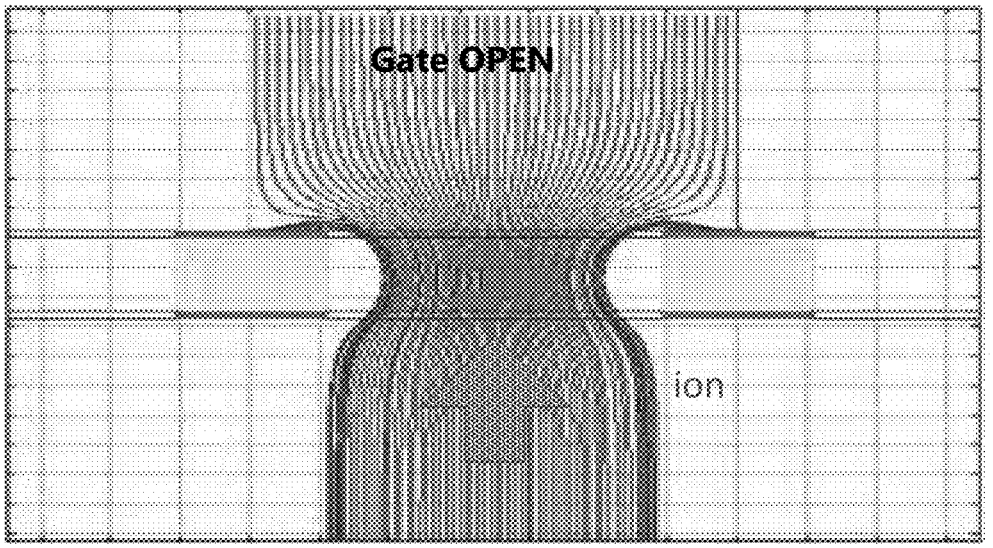
FIG. 3A is a first view for describing the movement of ions when the ion filter operates according to one or more embodiments of the present invention.
Figure 3B:
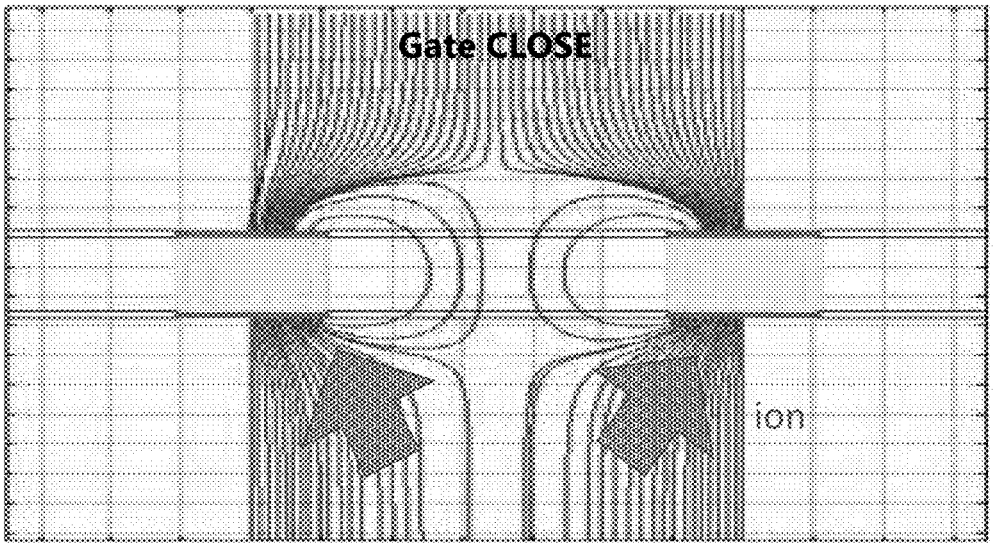
FIG. 3B is a second view for describing the movement of ions when the ion filter operates according to one or more embodiments of the present invention.

FIGS. 3A and 3B are views each illustrating the movement of ions in the vicinity of the ion filter 1 when the ion filter 1 operates as a gate. FIG. 3A illustrates the movement of ions when the ion filter 1 operates in a "gate open mode" for passing electrons to generate a signal. FIG. 3B illustrates the movement of ions when the ion filter 1 operates in a "gate closed mode" for capturing the positive ions. As previously described, the fed-back positive ions gather and move in a flat plate-like shape, and the ion filter 1 can therefore be switched between the open mode and the closed mode in accordance with the position of a positive-ion disk which is estimated on the basis of the control contents including the control timing of the TPC 100.

The first conductive layer of the ion filter 1 according to one or more embodiments of the present invention is formed with a first conductive layer pattern while the second conductive layer is formed with a second conductive layer pattern. One main surface side (the first conductive layer) of the insulating substrate is disposed on the upstream side in the movement direction of electrons in the gas detector 100, and the other main surface side (the second conductive layer) of the insulating substrate is disposed on the downstream side in the movement direction of electrons in the gas detector 100. That is, in one or more embodiments of the present invention, the first conductive layer pattern is disposed on the upstream side in the movement direction of electrons in the gas detector 100, and the second conductive layer pattern is disposed on the downstream side in the movement direction of electrons in the gas detector 100.

Figure 4A:
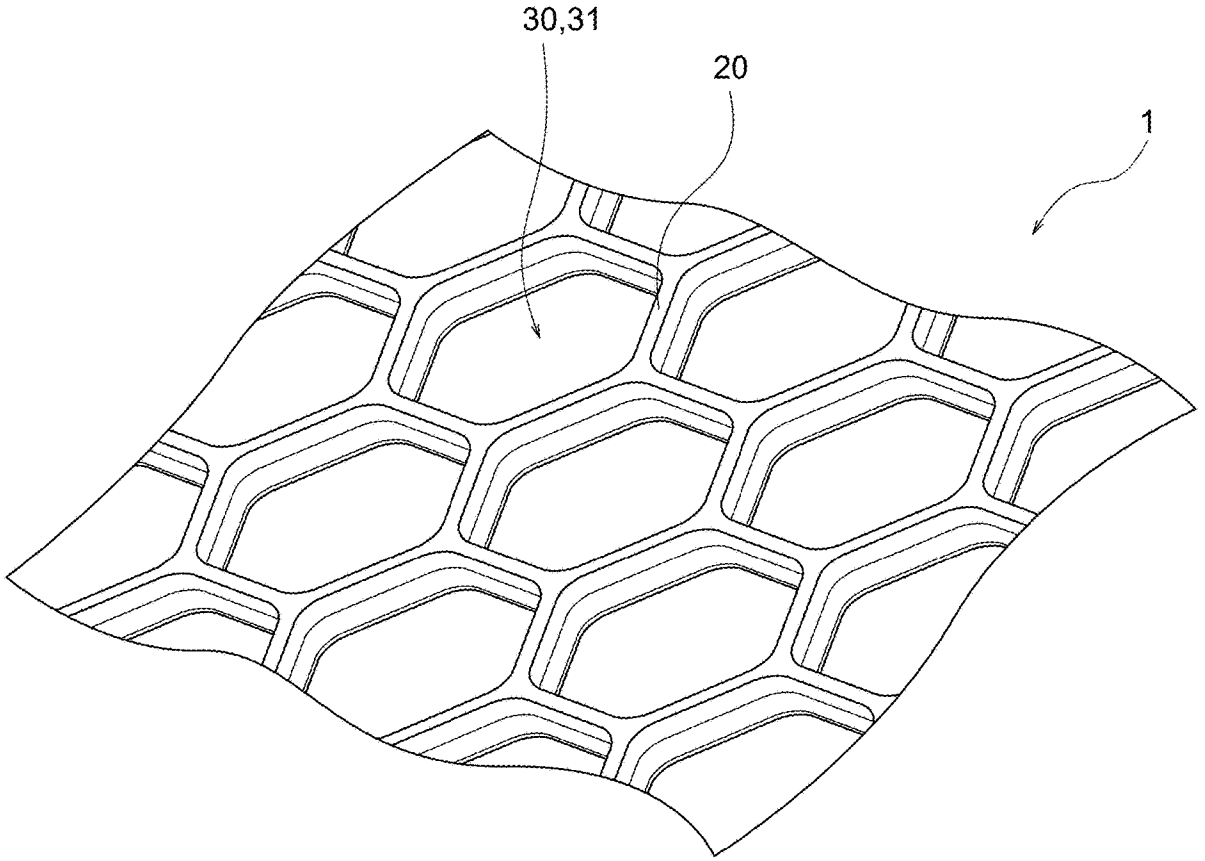
FIG. 4A is a perspective view schematically illustrating an example of the ion filter according to one or more embodiments of the present invention.
Figure 4B:
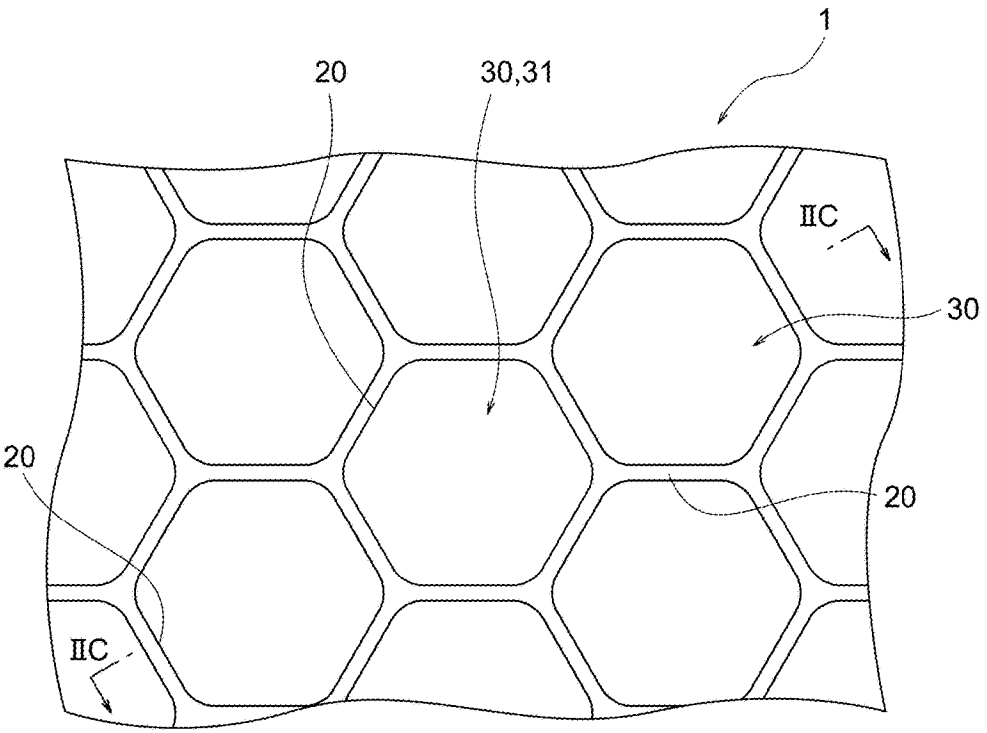
FIG. 4B is a plan view schematically illustrating an example of the ion filter according to one or more embodiments of the present invention.
Figure 4C:
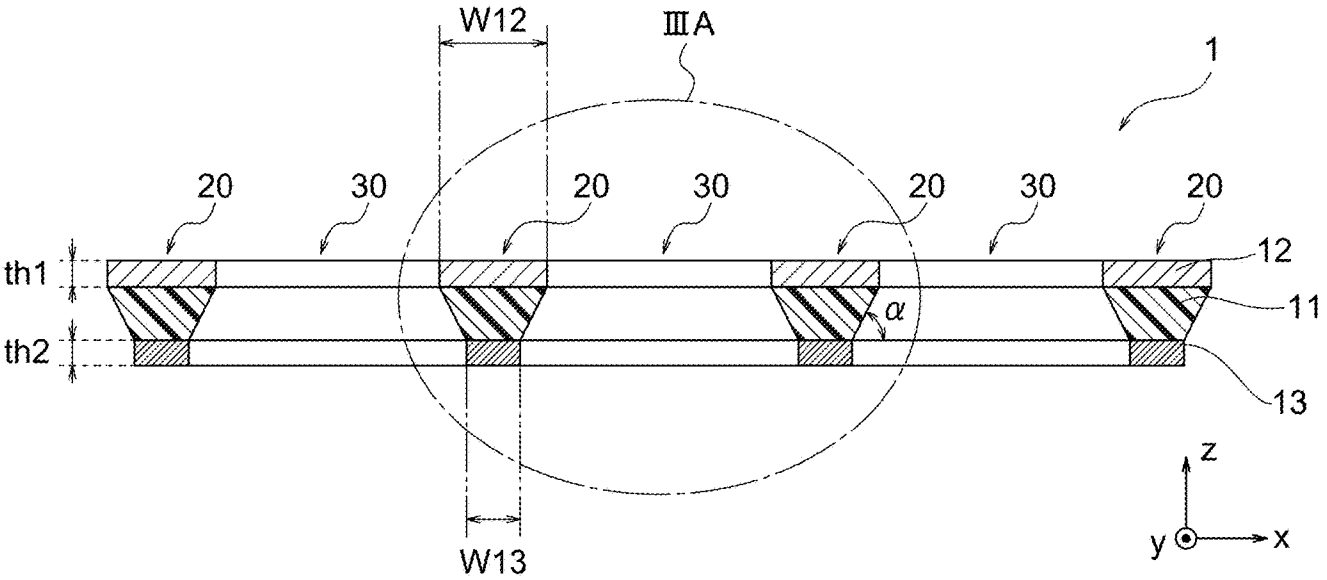
FIG. 4C is a cross-sectional view schematically illustrating a first example of the cross section along line IIC-IIC illustrated in FIG. 4B.

FIGS. 4A to 4C are views schematically illustrating an example of the ion filter 1 according to one or more embodiments of the present invention.

FIG. 4A is a perspective view of the ion filter 1 according to one or more embodiments of the present invention and FIG. 4B is a plan view of the ion filter 1 according to one or more embodiments of the present invention.

As illustrated in each figure, the ion filter 1 according to one or more embodiments of the present invention has through-holes 30. A rim 20 is formed between adjacent through-holes 30. The through-holes 30 are surrounded by the rim 20. The rim 20 forms inner walls for the through-holes 30. The through-holes 30 form apertures 31 arranged along the main surfaces of the ion filter 1. The rim 20 comprises an insulating substrate having a honeycomb structure, a first conductive layer pattern formed on one main surface of the insulating substrate, and a second conductive layer pattern formed on the other main surface of the insulating substrate. The through-holes 30 are surrounded by the rim 20, which forms a part of inner walls for the through-holes 30 (on the upper surface side and the lower surface side). The shape of the through-holes 30 according to one or more embodiments of the present invention is a hexagonal (polygonal) shape in the plan view. The ion filter 1 according to one or more embodiments of the present invention has a so-called honeycomb structure.

The distance between parts of the rim 20 which surround each of the through-holes 30 may be 140 [μm] to 300 [μm]. The width of the rim 20 (distance between the nearest inner walls for the through-holes 30) may be 45 [μm] or less, appropriately 40 [μm] or less, and more appropriately 35 [μm] or less.

The ion filter 1 according to one or more embodiments of the present invention serves to collect the fed-back positive ions so that they do not move toward the drift region DR, but is constrained so as not to impede the movement of electrons to be measured. For this reason, the ion filter 1 for use is required to have a structure in which the hole-area ratio of the through-holes is high and the thickness is thin.

Simulation conducted by the present inventor and his colleagues has revealed that the hole-area ratio of the through-holes 30 of the ion filter 1 is appropriately 65% or more, more appropriately 70% or more, and most appropriately 75% or more in order not to impede the movement of electrons, that is, in order for the ion filter 1 to function as expected. In one or more embodiments of the present invention, the hole-area ratio of the through-holes 30 refers to a ratio of the total area of the apertures 31 formed by the through-holes 30 to a predetermined unit area along the main surfaces of the insulating substrate. The unit area for calculating the hole-area ratio can be arbitrarily defined. The apertures 31 are two-dimensional regions which are along the main surfaces of the ion filter 1 and within which the insulating substrate and the conductive layers are not present. The shape of the apertures 31 of the through-holes 30 according to one or more embodiments of the present invention is approximately a hexagonal shape. The ion filter 1 according to one or more embodiments of the present invention has a so-called honeycomb structure.

The simulation conducted by the present inventor and his colleagues has also revealed that the thickness of an insulating substrate 11 of the ion filter 1 is appropriately 25 [μm] or less in order not to impede the movement of electrons. It has been further found that the line width of the first conductive layer pattern and the line width of the second conductive layer pattern are in a specific relationship, as will be described later.

According to one or more embodiments of the present invention, the ion filter 1 is provided to satisfy such conditions.

The ion filter 1 according to one or more embodiments of the present invention is disposed on the upstream side (the side of the electrode 5 and drift region DR) of the electron multiplier foil 2 as the gas electron multiplier 2, which multiplies electrons, as a separate member from the electron multiplier foil 2. The ion filter 1 according to one or more embodiments of the present invention is used for the purpose of collecting positive ions generated due to the electron multiplication, which is a different purpose than that of the electron multiplier foil 2, and has a different function than that of the electron multiplier foil 2.

In one or more embodiments of the present invention, the ion filter 1 is disposed on the upper stream side (the side provided with the electrode 5, i.e., the side provided with the drift region DR) than the gas electron multiplier 2 in the movement direction E of electrons. That is, the ion filter 1 is disposed between the gas electron multiplier 2 and the electrode 5. Such arrangement of the ion filter 1 allows the ion filter 1 to collect the positive-ion cloud generated in the gas electron multiplier 2 and prevents the fed-back positive ions from affecting the entire drift region DR. Thus, the positive ion cloud is less likely to affect the drifting electrons.

The ion filter 1 according to one or more embodiments of the present invention is provided together with the gas electron multiplier 2 of the TPC 100 in a side-by-side fashion. The gas electron multiplier 2 may be a flat plate-like electron multiplier foil 2 or may also in a different structure, provided that it can multiply electrons.

FIG. 4C is a cross-sectional view of the ion filter 1 according to one or more embodiments of the present invention along line IIC-IIC illustrated in FIG. 4B.

As illustrated in FIG. 4C, the ion filter 1 according to one or more embodiments of the present invention includes a first conductive layer pattern 12 formed on one main surface of the insulating substrate 11 and a second conductive layer pattern 13 formed on the other main surface of the insulating substrate 11. The first conductive layer pattern 12 and the second conductive layer pattern 13 are applied with an electric potential that is preliminarily set. As illustrated in FIG. 4C, the ion filter 1 according to one or more embodiments of the present invention is configured such that the line width W12 of the first conductive layer pattern 12 formed on one main surface of the insulating substrate 11 is different from the line width W13 of the second conductive layer pattern 13 formed on the other main surface of the insulating substrate 11. Specifically, in one or more embodiments of the present invention, the ion filter 1 is configured such that the line width W12 of the first conductive layer pattern 12 on the upstream side in the movement direction of electrons (arrow E) is longer than the line width W13 of the second conductive layer pattern.

The cross section of the insulating substrate 11, which constitutes the rim 20, is formed in a trapezoidal shape in which the length of the side on one main surface side is longer than the length of the side on the other main surface side. As illustrated in FIG. 4C, the first conductive layer pattern 12 is formed on the entire surface of the one main surface of the insulating substrate 11, and the second conductive layer pattern 13 is formed on the entire surface of the other main surface of the insulating substrate 11. The first conductive layer pattern 12 has a shape corresponding to the one main surface of the honeycomb-shaped insulating substrate 11 having the through-holes 30, and the second conductive layer pattern 13 has a shape corresponding to the other main surface of the honeycomb-shaped insulating substrate 11 with the through-holes 30.

The line width W12 of the first conductive layer pattern 12 may be shorter or longer than the width of the insulating substrate 11 which constitutes the rim 20, provided that the line width W12 of the first conductive layer pattern 12 is longer than the line width W13 of the second conductive layer pattern 13. In other words, the first conductive layer pattern 12 may be formed on a part of the one main surface of the insulating substrate 11 rather than on the entire surface of the one main surface of the insulating substrate 11. That is, the first conductive layer pattern 12 may be formed such that its line width W12 is shorter than the width of the one main surface of the insulating substrate 11 which constitutes the rim 20. The first conductive layer pattern 12 may also be formed to protrude from the one main surface of the insulating substrate 11 toward the center side of each through-hole 30. That is, the first conductive layer pattern 12 may be formed such that its line width W12 is longer than the width of the one main surface of the insulating substrate 11 which constitutes the rim 20.

To ensure the hole-area ratio of the through-holes 30 and the electron transmittance through the through-holes 30, the line width W13 of the second conductive layer pattern 13 is approximately the same as the width of the other main surface of the insulating substrate 11 which constitutes the rim 20. That is, as illustrated in one or more embodiments of the present invention, the second conductive layer pattern 13 is formed on the entire surface of the other main surface of the insulating substrate 11 having the through-holes 30.

Provided that the line width W12 of the first conductive layer pattern 12 is longer than the line width W13 of the second conductive layer pattern 13, the cross-sectional shape of the insulating substrate 11, which forms the rim 20 together therewith, is not limited to a trapezoidal shape, and may also be rectangular. In this case, the first conductive layer pattern 12 is formed on a part of the one main surface of the insulating substrate 11.

The ion filter 1 according to one or more embodiments of the present invention is formed such that the second conductive layer pattern 13 overlaps with the first conductive layer pattern 12 when viewed from the upstream side in the movement direction of electrons (arrow E), that is, from the one main surface side of the insulating substrate 11. In particular, the second conductive layer pattern 13 is arranged and formed such that the entire region of the second conductive layer pattern 13 overlaps with the first conductive layer pattern 12 (so as to be included in the region of the first conductive layer pattern 12).

In the ion filter 1 according to one or more embodiments of the present invention, the line width W12 of the first conductive layer pattern 12 may be, but is not limited to being, 10 [μm] or more and 40 [μm] or less. From the viewpoint of preventing the delamination of the first conductive layer pattern 12, the line width W12 of the first conductive layer pattern 12 is 10 [μm] or more. From the viewpoint of improving the electron transmittance, the line width W12 of the first conductive layer pattern 12 is 40 [μm] or less. In one or more embodiments of the present invention, the line width W12 of the first conductive layer pattern 12 is set to 35 [μm]. In one or more embodiments of the present invention, the line width W12 of the first conductive layer pattern 12 is set to 30 [μm].

The line width W13 of the second conductive layer pattern 13 is 0.4 times or more and 0.9 times or less the line width W12 of the first conductive layer pattern 12 according to one or more embodiments of the present invention. The line width W13 of the second conductive layer pattern 13 is 0.5 times or more and 0.7 times or less the line width W12 of the first conductive layer pattern 12 according to one or more embodiments of the present invention. This is because the structural strength cannot be maintained if the line width W13 of the second conductive layer pattern 13 is less than 0.4 times the line width W12 of the first conductive layer pattern 12. The thickness of the ion filter 1 according to one or more embodiments of the present invention is very thin as described later. This thin sheet-like ion filter 1 is fixed to the module while applying tension to maintain the position of the main surface (direction of the surface) constant. Constant tension is therefore constantly applied to the ion filter 1. Thus, in a state in which the ion filter 1 is fixed to the module with certain tension, if the line width W13 of the second conductive layer pattern 13 is less than 0.4 times the line width W12 of the first conductive layer pattern 12, it will be difficult to maintain the structural strength of the ion filter 1.

In an example in which the line width W12 of the first conductive layer pattern 12 is set to a maximum value of 40 [μm], the lower limit of the line width W13 of the second conductive layer pattern 13 is 40×0.30=12 [μm] or 40×0.40=16 [μm]. According to the simulation conducted by the inventor and his colleagues regarding the occurrence of delamination, it has been found that the possibility of delamination of the second conductive layer pattern 13 increases as the line width W13 of the second conductive layer pattern 13 decreases. In one or more embodiments of the present invention, on the basis of the simulation conducted by the inventor and his colleagues regarding the occurrence of delamination, the line width W13 of the second conductive layer pattern 13 is set to 0.4 times or less the line width W12 of the first conductive layer pattern 12, and the delamination of the second conductive layer pattern 13 can thereby be suppressed. Likewise, the line width W13 of the second conductive layer pattern 13 is set to 0.30 times or less the line width W12 of the first conductive layer pattern 12, and the delamination of the second conductive layer pattern 13 can thereby be suppressed. On the other hand, if the line width W13 of the second conductive layer pattern 13 exceeds 0.9 times the line width W12 of the first conductive layer pattern 12, expected effects may not be obtained.

The area of a first aperture of each through-hole 30 on the first conductive layer pattern 12 side is smaller than the area of a second aperture of the through-hole 30 on the second conductive layer pattern 13 side. The inner surface, which forms each through-hole 30 on the second conductive layer pattern side, has an inclination angle α with respect to the main surface (xy plane in FIG. 4C) of the insulating substrate 11. The inclination angle α is uniform along the edge of the aperture of the through-hole 30 on the second conductive layer pattern side according to one or more embodiments of the present invention. The inclination angle α may be, but is not limited to being, 40 degrees or more and 70 degrees or less. The inclination angle α is 50° or more and 69° or less according to one or more embodiments of the present invention.

In an example, when the thickness of the insulating substrate 11 is 12.5 [μm], the line width W12 of the first conductive layer pattern 12 is 35 [μm], and the line width W13 of the second conductive layer pattern 13 is 25 [μm], the inclination angle α of the inner surface of the through-hole 30 is 69°. When the thickness of the insulating substrate 11 is 15 [μm], the line width W12 of the first conductive layer pattern 12 is 35 [μm], and the line width W13 of the second conductive layer pattern 13 is 10 [μm], the inclination angle α of the inner surface of the through-hole 30 is 50°.

In the ion filter 1 according to one or more embodiments of the present invention, the thickness th1 of the first conductive layer pattern 12 and the thickness th2 of the second conductive layer pattern 13 are not particularly limited. The thicknesses may be the same or may also be different. The thickness th1 of the first conductive layer pattern 12 and the thickness th2 of the second conductive layer pattern 13 are 5.0 [μm] or less according to one or more embodiments of the present invention. In one or more embodiments of the present invention, the thicknesses of the first conductive layer pattern 12 and second conductive layer pattern 13 may appropriately be, but are not limited to being, 1 to 4 [μm] and more appropriately 3 [μm] or less.

In the ion filter 1 according to one or more embodiments of the present invention, the first conductive layer pattern 12 is formed of a material that contains one or more substances selected from the group consisting of copper, nickel, gold, tungsten, zinc, aluminum, chromium, tin, and cobalt. The second conductive layer pattern 13 is also formed of a material that contains one or more substances selected from the group consisting of copper, nickel, gold, tungsten, zinc, aluminum, chromium, tin, and cobalt, but the material of the second conductive layer pattern 13 is different from the material of the surface portion of the first conductive layer pattern 12.

Gold is suitable for the first conductive layer pattern 12 and the second conductive layer pattern 13 because of its stability. Aluminum is suitable for the first conductive layer pattern 12 and the second conductive layer pattern 13 because of its light weight. The use of aluminum can reduce the weight of the ion filter 1 and therefore of the gas detector 100. Nickel is suitable for the first conductive layer pattern 12 and the second conductive layer pattern 13 because of its rigidity (strength). The rigidity contributes to the enhanced strength of the ion filter 1. Moreover, nickel is suitable for the first conductive layer pattern 12 and the second conductive layer pattern 13 because of its dimensional stability. The dimensional stability contributes to the flatness of the ion filter 1. Tungsten is suitable for the first conductive layer pattern 12 and the second conductive layer pattern 13 because of its hardness. The hardness contributes to the enhanced tensile strength of the ion filter 1. The use of a material having high strength or a metal having high flatness allows the work to be easily performed when a large film is attached to a frame or the like.

Aluminum, chromium, cobalt, and nickel are suitable for the first conductive layer pattern 12 and the second conductive layer pattern 13 because the multiple Coulomb scattering is smaller than that with copper. The multiple Coulomb scattering affects the trajectories of electrons. If the trajectories of electrons are affected, the accuracy of a measurement process that is performed using an ILD measurement device at the subsequent stage will also be affected. Small multiple Coulomb scattering contributes to the improvement in the measurement accuracy when using the detection results.

Gold, chromium, zinc, cobalt, nickel, tungsten, and tin are suitable for the first conductive layer pattern 12 and the second conductive layer pattern 13 because they have reactivity in the gamma-ray region. The reactivity in the gamma-ray region improves the detection efficiency of gamma rays. This contributes to the improvement in the detection accuracy of gas radiation detectors, such as a gamma camera and nondestructive tester.

Cobalt, nickel, chromium, and tungsten are suitable for the first conductive layer pattern 12 and the second conductive layer pattern 13 because of high rigidity. The ion filter 1 having a thin structure formed with a large number of through-holes is likely to be affected by the deformation and/or wire breaking. High rigidity contributes to the enhanced strength of the ion filter 1.

In one or more embodiments of the present invention, any one or both of the first conductive layer pattern 12 and the second conductive layer pattern 13 are formed of a material that contains copper. Copper is easy to work and thus suitable for production of the thin rim 20 and the pattern with a high hole-area ratio as in one or more embodiments of the present invention, and is also easily available.

In the ion filter 1, the surface of the first conductive layer pattern 12 may be formed of nickel. In the ion filter 1, the surface of the second conductive layer pattern 13 may also be formed of nickel.

In the gas detector 100 including the gas electron multiplier (electron multiplier foil) 2 according to one or more embodiments of the present invention, the ion filter 1 is provided together with the gas electron multiplier 2 in a side-by-side fashion. One main surface of the insulating substrate 11, which constitutes the ion filter 1, is disposed on the electrode 5 side while the other main surface of the insulating substrate 11 is disposed on the gas electron multiplier (electron multiplier foil) 2 side. The line width W13 of the second conductive layer pattern 13 formed on the other main surface is shorter than the line width W12 of the first conductive layer pattern 12 formed on the one main surface. Provided that the gas electron multiplier 2 can multiply electrons, the gas electron multiplier 2 may not be the electron multiplier foil 2.

Electrons passing through each through-hole 30 of the ion filter 1 are collected in the center of the through-hole 30 in accordance with the electric field formed inside the through-hole 30 and pass through the through-hole 30 along a predetermined direction (direction of the arrow E illustrated in FIG. 1). If no gas molecules are present, the electrons drift in accordance with the electric field direction in the through-hole 30 and are therefore not absorbed in the insulating substrate 11, and an ideal electron transmittance can be achieved.

In reality, however, due to the presence of gas molecules, the electrons collide with the gas molecules and pass through the through-holes 30 even in accordance with the electric field, while moving in a directional component substantially perpendicular to the direction of the electric field (indicated by the arrow E in the figure). That is, the electrons pass through the through-holes 30 while drawing electron drift trajectories including the behavior caused by the collision with gas molecules. In other words, the trajectories of electrons may not be parallel to the direction E of the electric field. If, in this case, the electrons approach the insulating substrate 11 which constitutes the inner walls of the through-holes 30, the electrons may be absorbed by the insulating substrate 11. If the electrons are absorbed by the insulating substrate 11, the number of electrons arriving at the detection electrode 3 will decrease to deteriorate the electron transmittance, which may become a matter to be resolved.

Figure 5A:
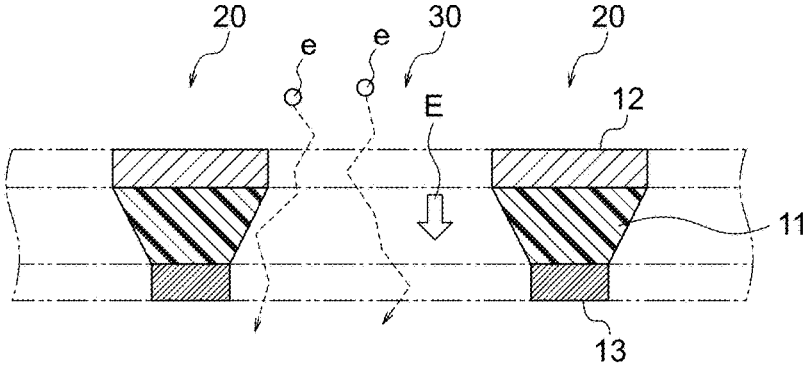
FIG. 5A is a schematic view in which region IIIA indicated by a dashed line in FIG. 4C is enlarged.

FIG. 5A schematically represents a behavior model of electrons e passing through each through-hole 30 of the ion filter 1 according to one or more embodiments of the present invention. When passing through the through-hole 30, the electrons e move along the direction of the electric field (indicated by the arrow E in the figure) while drifting. The inner wall surface of the through-hole 30 according to one or more embodiments of the present invention is inclined with respect to the thickness direction (which is also the direction of the electric field) of the insulating substrate 11. The width (size) of the aperture of the through-hole 30 according to one or more embodiments of the present invention gradually expands from the upstream side to the downstream side in the electric field direction (arrow E). Thus, even when the electrons e move in a direction different from the direction of the electric field (indicated by the arrow E in the figure), the probability of contact with the insulating substrate 11 is low.

This behavior model of electrons is based on the ion filter 1 in which the thickness of the insulating substrate 11 made of polyimide is 12 to 25 [μm], the thickness of the first conductive layer pattern 12 is 12 [μm], the thickness of the second conductive layer pattern 13 is 12 [μm], the line width W12 of the first conductive layer pattern 12 is 35 [μm], and the inclination angle α of the through-holes 30 is 50° to 60°. The test environment of TPC in the ILC experiment is assumed under the following condition.

Gas used: Ar—$CF_4$-iso$C_4H_{10}$ (95:3:2)

$\omega \cdot \tau > 10$

Drift electric field: 230 V/cm

Magnetic field: 3.5 T

Figure 5B:
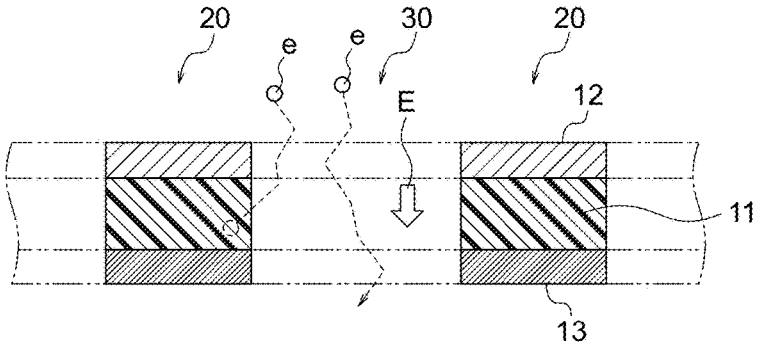
FIG. 5B is a view relating to a comparative example, which is a schematic view corresponding to FIG. 5A.

For comparison, FIG. 5B schematically represents the behavior of electrons e passing through a waistless through-hole 30 having the same inner diameter. As previously described, when passing through the through-hole 30, the electrons e move along the direction of the electric field (indicated by the arrow E in the figure) while drifting. The inner wall surface of the through-hole 30 of this comparative embodiment is parallel to the thickness direction of the insulating substrate 11. The width of the aperture of the through-hole 30 is equal from the upstream side to the downstream side in the electric field direction (arrow E).

Thus, when the electrons e pass through the through-hole 30 while moving in the directional component substantially perpendicular to the direction of the electric field, the probability of contact with the insulating substrate 11 is higher than that in the aforementioned embodiments illustrated in FIG. 5A.

The ion filter 1 according to one or more embodiments of the present invention is configured such that the line width W13 of the second conductive layer pattern 13 on the other main surface, which is disposed on the gas electron multiplier 2 side, of the insulating substrate 11 is shorter than the line width W12 of the first conductive layer pattern 12 on the one main surface, which is disposed on the electrode 5 side, of the insulating substrate 11.

In one or more embodiments of the present invention, the line width W13 of the second conductive layer pattern 13 on the downstream side is set shorter than the line width W12 of the first conductive layer pattern 12 on the upstream side with reference to the movement direction of electrons (arrow E), and the distances between electrons and the insulating substrate 11 which constitutes the inner wall surface of each through-hole 30 can thereby be increased. It is therefore possible to reduce the absorption of electrons by the insulating substrate 11. As a result, the transmittance of electrons to be measured can be maintained or improved. Moreover, the ion filter 1 having the first conductive layer pattern 12 and the second conductive layer pattern 13, between which a certain voltage is applied, can prevent the positive ions generated in the electron multiplier foil 2 from moving toward the electrode 5 side.

As described above, when the line width W12 of the first conductive layer pattern 12 is set longer than the line width W13 of the second conductive layer pattern 13 as in one or more embodiments of the present invention, the electron transmittance and the detection accuracy can be improved as compared with a case in which the line width W12 of the first conductive layer pattern 12 is the same as the line width W13 of the second conductive layer pattern 13.

A method of manufacturing the ion filter 1 according to one or more embodiments of the present invention will now be described with reference to FIGS. 6A to 6D. FIGS. 6A to 6D are illustrated as end elevational views for easy understanding of the manufacturing steps.

Figure 6A:
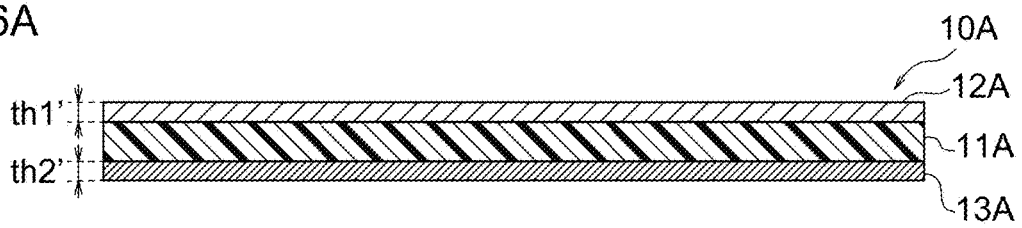
FIGS. 6A to 6D are views for describing a method of manufacturing an ion filter according to one or more embodiments of the present invention.

First, as illustrated in FIG. 6A, a substrate 10A is prepared in which a conductive layer 12A is formed on one main surface (upper surface in the figure) of a plate-like insulating substrate 11A and a conductive layer 13A is formed on the other main surface (lower surface in the figure). Although not particularly limited, the insulating substrate 11A of the substrate 10A used in one or more embodiments of the present invention has a thickness of 12 [μm] to 25 [μm]. In one or more embodiments of the present invention, the insulating substrate 11A made of polyimide having a thickness of 12.5 [μm] is used.

The thickness th1 of the conductive layer 12A and the thickness th2 of the conductive layer 13A may be the same or may also be different. Although not particularly limited, in the substrate 10A used in one or more embodiments of the present invention, the thickness of the conductive layer 12A and the thickness of the conductive layer 13A are 1 [μm] or more and less than 15 [μm]. In one or more embodiments of the present invention, the thickness th1 of the conductive layer 12A made of copper is 3 [μm] or more, and the thickness th2 of the conductive layer 13A made of copper is 3 [μm] or less.

As will be understood, the insulating substrate 11A illustrated in FIG. 6A corresponds to the insulating substrate 11 of the ion filter 1, the conductive layer 12A corresponds to the first conductive layer pattern 12 of the ion filter 1, and the conductive layer 13A corresponds to the second conductive layer pattern 13 of the ion filter 1.

In one or more embodiments of the present invention, the second conductive layer pattern 13 having a relatively narrow line width is formed first.

Figure 6B:
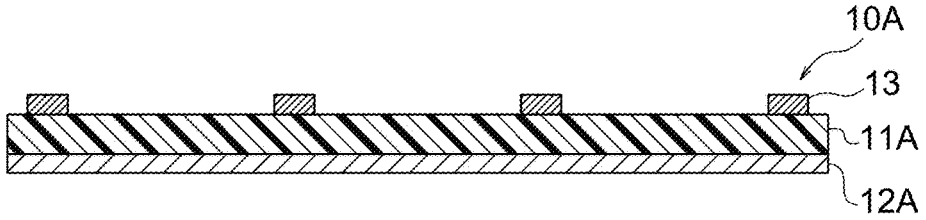

For this reason, in FIG. 6B, the top and bottom of the substrate 10A illustrated in FIG. 6A are reversed.

As illustrated in FIG. 6B, predetermined regions of the conductive layer 13A are removed using a known photolithographic technique to form the second conductive layer pattern 13 having a predetermined pattern. In one or more embodiments of the present invention, the predetermined pattern is a honeycomb pattern.

In one or more embodiments of the present invention, the line width W13 of the second conductive layer pattern 13 is 40% or more and 90% or less of a range of 10 [μm] to 40 [μm]. That is, the line width W13 of the second conductive layer pattern 13 is 4.0 [μm] or more and 36 [μm] or less according to one or more embodiments of the present invention.

Then, portions of the insulating substrate 11 corresponding to the predetermined regions are removed.

Figure 6C:
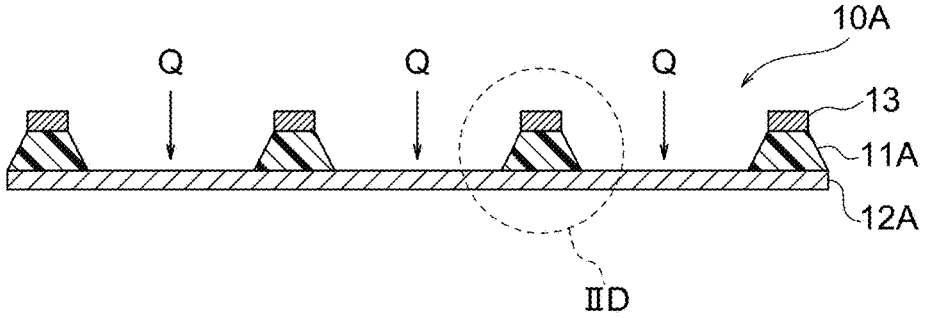

As illustrated in FIG. 6C, irradiation with UV-YAG laser of a wavelength of 500 [nm] or less is performed from the one main surface side (upper side in the figure) formed with the second conductive layer pattern 13. For example, UV-YAG laser of third harmonic (wavelength of 355 [nm]) is used. The second conductive layer pattern 13 formed to have the predetermined honeycomb pattern serves as a mask to the laser irradiation from the one main surface side, so that the regions of the insulating substrate 11 (hexagonal regions in this example) corresponding to the predetermined regions are removed. The insulating substrate 11 is partially removed up to the other main surface side from the one main surface side to form through-holes.

This step of partially removing the insulating substrate 11 may also be performed using an etching liquid. When the substrate 10A in the state illustrated in FIG. 6B is immersed in the etching liquid, the second conductive layer pattern 13 and the conductive layer 12A serve as masks to remove the regions of the insulating substrate 11 (hexagonal regions in this example) corresponding to the predetermined regions.

As illustrated in FIG. 6C, in the manufacturing method according to one or more embodiments of the present invention, the actual step of partially removing the insulating substrate 11, such as a polyimide substrate, includes tapering the boundary surface with each removed portion. For example, the output of the UV-YAG laser can be increased while reducing the irradiation time, or the output can be reduced while increasing the irradiation time, thereby to form the tapered surface having an arbitrary inclination angle α with respect to the main surface (xy plane in FIG. 4C) of the insulating substrate 11. In one or more embodiments of the present invention, the output intensity and irradiation time of the laser are adjusted so that the inclination angle α of the inner surface of each through-hole 30 with respect to the main surface (xy plane in FIG. 4C) of the insulating substrate 11 comes to an angle of 40° or more and 80° or less.

A desmear process such as a plasma desmear process is carried out. Various schemes known in the art at the time of filing of the present application may be appropriately used for the desmear process depending on the scheme of partially removing the insulating substrate 11.

Finally, portions, which correspond to the above predetermined regions, of the conductive layer 12A formed on the other main surface of the insulating substrate 11 are removed using an etching liquid to form the first conductive layer pattern 12. The etching liquid can be appropriately selected in accordance with the material of the conductive layer 12A. When the first conductive layer pattern 12 is made of copper, a mixed liquid of sulfuric acid and hydrogen peroxide is used. In this process, the etching liquid is made to act from the other main surface side (the second conductive layer pattern 13 side). In addition or alternatively, the etching liquid may be made to act on the regions (regions to be removed) of the conductive layer 12A corresponding to the regions of through-holes from both surface sides (from the one main surface side and the other main surface side). The regions of the conductive layer 12A corresponding to the regions of through-holes are removed at a speed twice that for the remaining region.

Figure 6D:
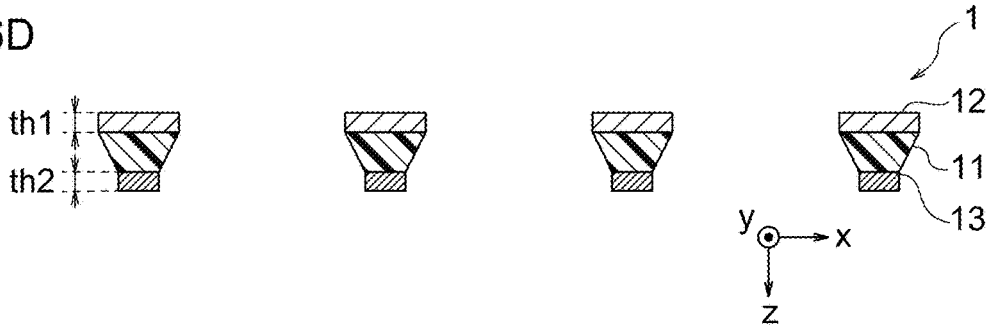

As a result, as illustrated in FIG. 6D, the through-holes can be formed to pass through from the one main surface side to the other main surface side. The ion filter 1 can thus be obtained which constitutes the predetermined pattern (e.g. honeycomb pattern).

It is not easy to form the rim 20 into a thin sheet because the rim 20 is formed with the through-holes 30 having a hole-area ratio of 75% or more. In the photolithographic technique at the time of filing of the present application, the exposure accuracy is said to be about ±10 [μm]. Poor exposure accuracy causes misalignment of etching patterns. It is also difficult to accurately perform an etching process for the insulating substrate 11. For example, inclination may occur in the etching process for polyimide. It is thus difficult to form the same patterns on both main surfaces of an insulating substrate at aligned locations and form through-holes to correspond to the patterns. In addition, to achieve a hole-area ratio of 75% or more, the width of the rim 20 may have to be 40 [μm] or less and therefore such conductive layers were not easy to form.

The manufacturing method according to one or more embodiments of the present invention performs etching using the known photolithographic technique only for the one main surface side, and performs etching for the other main surface side without using the known photolithographic technique. The misalignment of the etching pattern due to the exposure accuracy limit therefore does not occur. Thus, the ion filter 1 formed with the through-holes 30 according to one or more embodiments of the present invention can be manufactured. According to this manufacturing method, the hole-area ratio of the through-holes 30 can be 75% or more. Moreover, etching the conductive layer 13A on the other main surface side does not require any step of forming a resist for pattern formation. In the ion filter 1 of 100 mm×100 mm size to 170 mm×220 mm size manufactured by the present inventor and his colleagues, the electron transmittance of 80% has been achieved.

The method of manufacturing the ion filter 1 according to one or more embodiments of the present invention provides the ion filter 1 which has a structure that can suppress the movement of positive ions without affecting the movement and trajectories of electrons. In addition, the production cost can be reduced.

In the manufacturing method according to one or more embodiments of the present invention, the step after partially removing the insulating substrate 11A with laser and performing the desmear process may be replaced with the following step of forming an etching resist.

After the desmear process is performed, an etching resist is attached to the surface of the conductive layer 12A on the insulating substrate 11A. The etching resist covers the entire surface of the conductive layer 12A. An etching process is performed in the state in which the etching resist is attached. The etching process removes regions of the conductive layer 12A corresponding to the above predetermined regions. Thereafter, the etching resist is removed.

Also in the manufacturing method according to one or more embodiments of the present invention, the etching is performed only from the one main surface side, and the misalignment of the etching pattern due to the exposure accuracy limit therefore does not occur.

A manufacturing method according to one or more embodiments of the present invention will then be described.

Figure 7A:
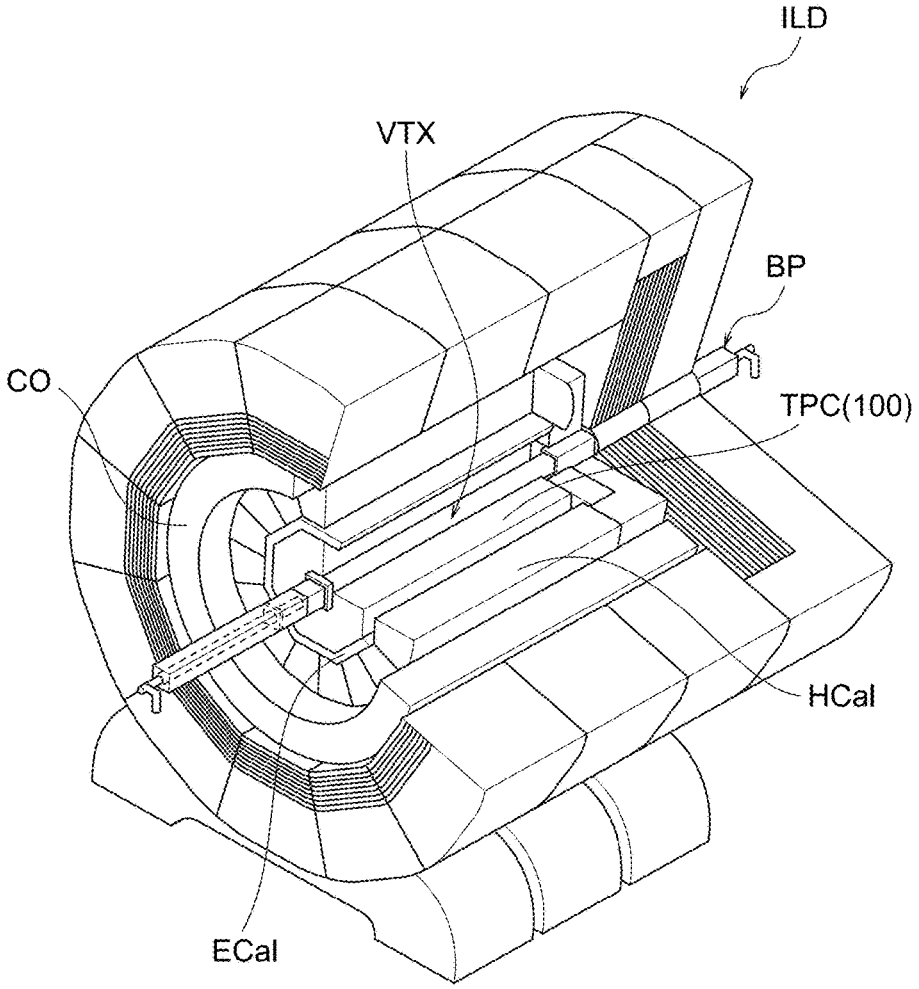
FIG. 7A is a view illustrating the overview of an international large detector (ILD) measurement device according to one or more embodiments of the present invention.

FIG. 7A illustrates the overview of an ILD measurement device (ILD) to which the ion filter 1 according to one or more embodiments of the present invention can be applied. The ILD measurement device (ILD) comprises a vertex detector (VTX), a gas detector 100 (TPC), and a calorie meter (ECal, HCal). The ILD measurement device (ILD) may include a muon detector. The ILD measurement device (ILD) has a cylindrical outer shape with an axis of a beam pipe (BP). The ILD measurement device (ILD) is provided therein with a coil (CO) that forms a magnetic field.

Figure 7B:
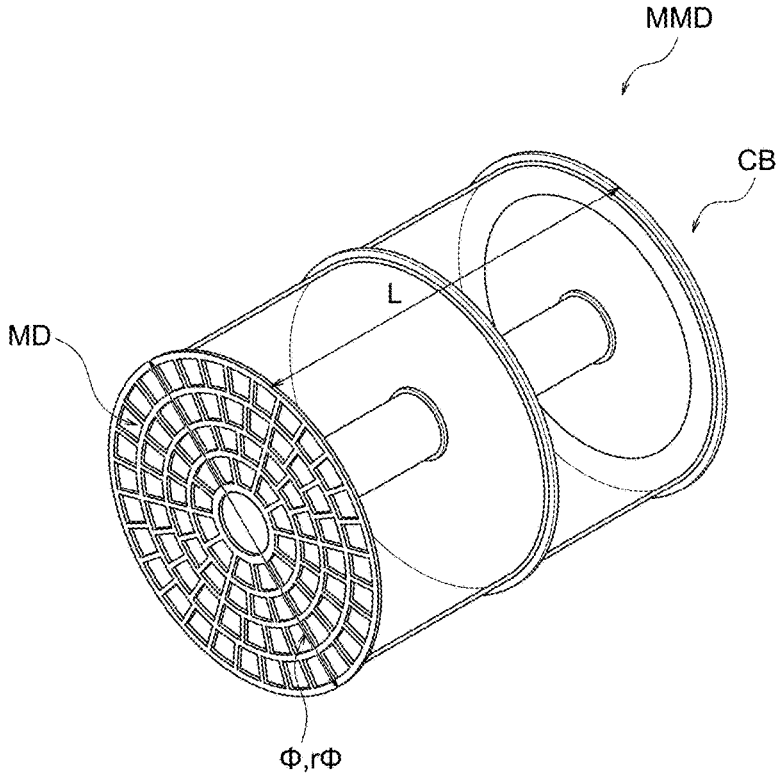
FIG. 7B is a view illustrating an example of the overview of a multi-module structure of a time projection chamber (TPC) according to one or more embodiments of the present invention.

As illustrated in the figure, the TPC 100 (central drift chamber) provided with the ion filter 1 according to one or more embodiments of the present invention has a cylindrical shape. FIG. 7B illustrates an example of the configuration of a multi-module (MMD) provided inside the TPC 100. The length of the multi-module (MMD) illustrated in FIG. 7B is 4 m to 6 m, for example, about 4 m. The TPC 100 used in the ILC experiment is required to have a readout region with a considerably wide area of a diameter (φ) of 2 m to 4 m, for example, 2 m from the relationship with the particles to be measured. To this end, the ILC-TPC employs a multi-module system as illustrated in FIG. 7B, and a number of sector-shaped unit modules of about 170 mm×220 mm size (portions indicated by MD in FIG. 7B, for example) are arranged to realize (provide) the readout region having a wide area.

As previously described, the ion filter 1 is a plate-like member that has the first conductive layer pattern 12 and second conductive layer pattern 13 on both surfaces of the insulating substrate 11 and is formed with a large number of through-holes having a high hole-area ratio. The ion filter 1 according to one or more embodiments of the present invention can suppress the E×B effect in a high magnetic field and suppress deterioration of the position resolution because the ion filter 1 is of a filter type (thin-plate shape) as compared with the conventional positive-ion gate device using wires. Moreover, in a gas electron multiplying mechanism of the multi-module system employing a foil-type electron multiplier such as a GEM, the film-type ion filter 1 can be easily incorporated in the module. In any of an ion filter-type positive-ion gate device and a wire-type positive-ion gate device, it is necessary to install and maintain the devices in a state in which a certain tension is applied from the viewpoint of improving the detection accuracy. The set of ion filter-type mechanisms does not require complicated mechanisms which may be necessary for installing and maintaining the set of wire-type mechanisms in a state in which a certain tension is applied. The use of ion filters 1 according to one or more embodiments of the present invention can suppress the occurrence of a dead region of the TPC 100 in which the ion filters 1 are disposed, and can maintain the detection accuracy.

Thus, the TPC 100 employing the multi-module system adopts the ion filters 1 of a filter type (thin-plate shape) according to one or more embodiments of the present invention. In the multi-module MMD of the TPC 100, however, there are particularly severe restrictions on the boundary between a module MD and another module MD in the direction of the radius rφ of the multi-module MMD. From the measurement accuracy requirement of the ILC-TPC, there is no boundary between the modules MD (the boundary width is zero) along the direction of the radius rφ.

Figure 7C:
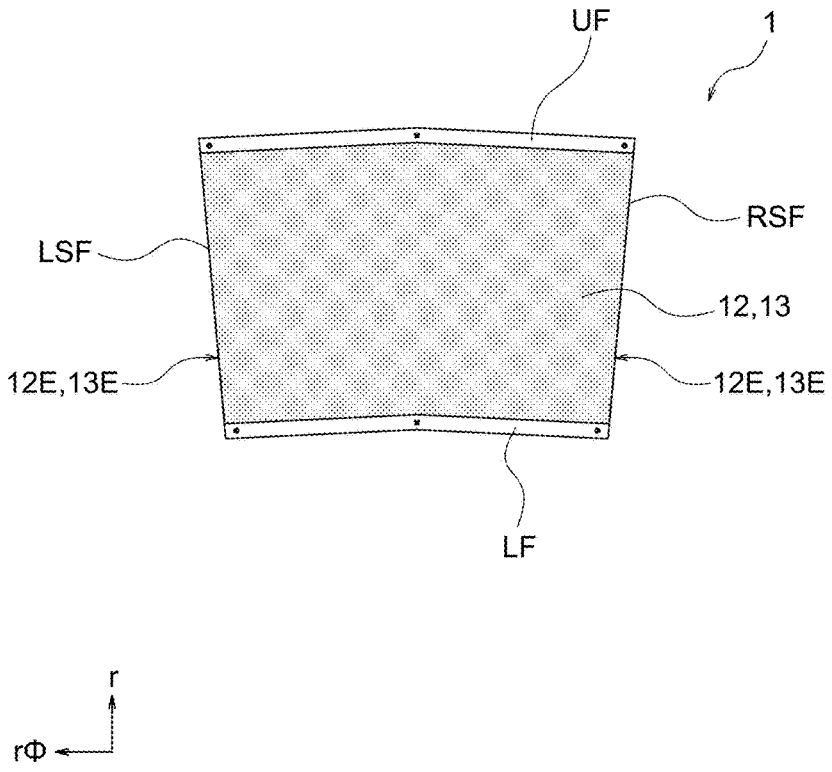
FIG. 7C is a view illustrating an ion filter according to one or more embodiments of the present invention, which is used for the multi-module illustrated in FIG. 7B.

FIG. 7C illustrates an example of the ion filter 1 incorporated in the unit module (MD) which constitutes the multi-module (MMD). End parts 12E and 13E of the first conductive layer pattern 12 and second conductive layer pattern 13 of the ion filter 1 correspond to outer boundaries of an upper end part UF, a lower end part LF, a right frame RSF, and a left frame LSF. What constitute the boundaries between modules MD along the direction of the radius rφ are the right frame RSF and the left frame LSF. In the first place, ion filters 1 adjacent to each other as modules are separate bodies. To reduce the distance between the modules, therefore, it is required to reduce the widths of the right frame RSF and left frame LSF of each ion filter 1, that is, the distances from the right end (or the left end) of the ion filter 1 to the right ends (or the left ends) of the first conductive layer pattern 12 and the second conductive layer pattern 13.

The present inventor and his colleagues have conducted studies and simulation from the viewpoint of maintaining the position resolution and concluded that the widths of the right frame RSF and left frame LSF are appropriately 50 μm or less. However, the width of the rim 20 (the line width of the conductive layer patterns) of the ion filter 1 according to one or more embodiments of the present invention is very small as 35 μm, and the widths of the right frame RSF and left frame LSF are not easy to be set to 50 μm or less as comparable to the rim 20. The ion filter 1 forms a drift region (electric field) of the TPC 100 and, therefore, the polyimide may have to be avoided from exposing on the one main surface side of the ion filter 1, in particular, disposed on the upstream side. If the polyimide of the ion filter 1 is exposed, the electric field formed in the drift region is disturbed, which will lead to poor position resolution of the TPC 100. That is, at the end parts of the ion filter 1, it is required to narrow the widths of the right frame RSF and left frame LSF without exposing the polyimide. To this end, the widths of the right frame RSF and left frame LSF are appropriately 50 μm or less.

Figure 8:
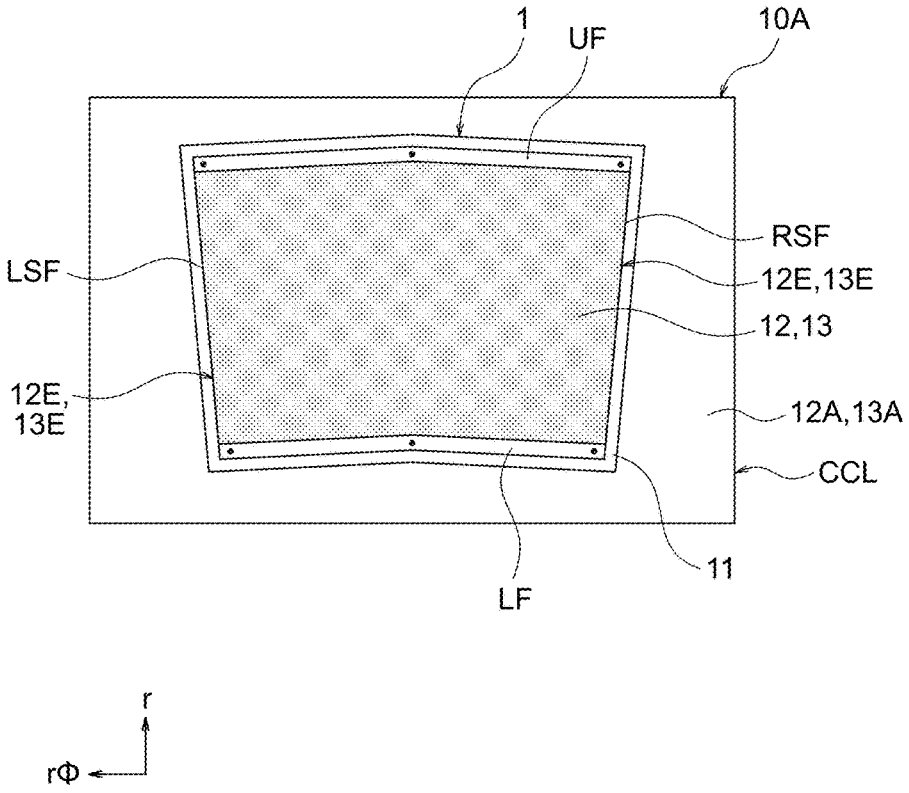
FIG. 8 is a view illustrating a substrate formed with the ion filter according to one or more embodiments of the present invention.

The ion filter 1 according to one or more embodiments of the present invention is manufactured using a photolithographic technique and therefore has to be finally cut out from the substrate 10A such as a copper clad laminate (CCL) because, as illustrated in FIG. 8, the ion filter 1 is formed on the substrate 10A. In the example illustrated in the figure, the metal layers (copper layers) around the ion filter 1 are removed to punch out the ion filter 1. For this reason, the insulating substrate 11 is exposed so as to surround the end parts 12E and 13E of the first and second layer patterns 12 and 13 of the ion filter 1.

Figure 9A:
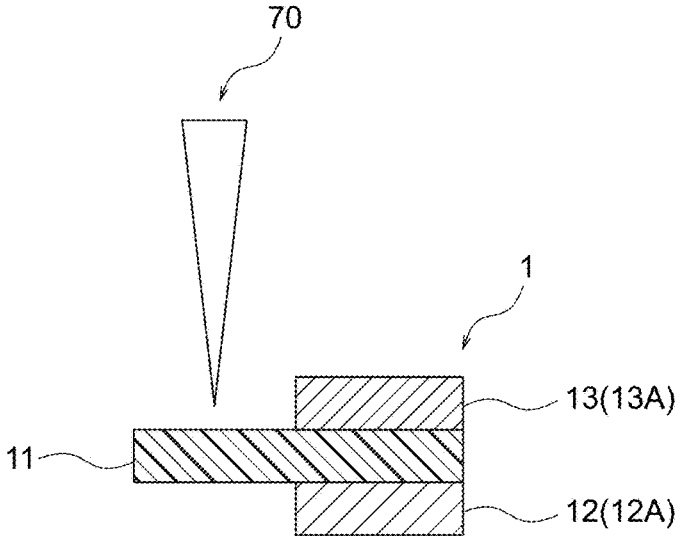
FIG. 9A is a view for describing a first scheme of punching out the ion filter from the substrate according to one or more embodiments of the present invention.
Figure 9B:
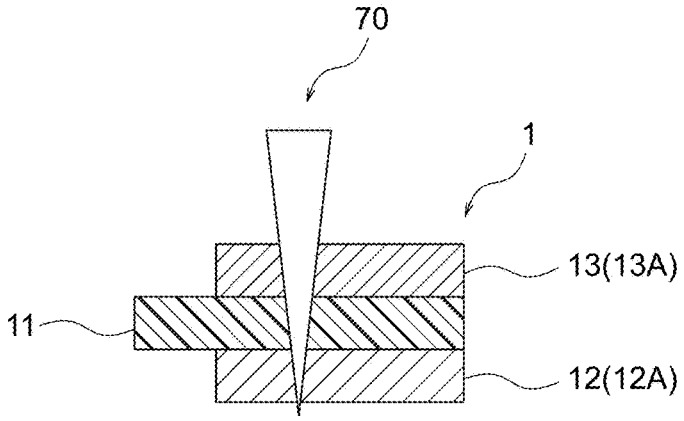
FIG. 9B is a view for describing a second scheme of punching out the ion filter from the substrate according to one or more embodiments of the present invention.

FIGS. 9A and 9B illustrate two examples of the cutting process of cutting out the ion filter 1 from the substrate 10A. To facilitate the comparison with the manufacturing method according to one or more embodiments of the present invention, the second conductive layer 13A is illustrated on the upper side of each figure in accordance with FIGS. 6B to 6D and FIGS. 10A to 10C.

As a process of cutting out the ion filter 1 from the substrate 10A, there is a method of cutting the substrate 11 (e.g. a polyimide material) which is exposed (the metal layers are removed) as illustrated in FIG. 9A. Laser (70), die/cutter (70), or the like can be used as a specific cutting means 70 for cutting the insulating substrate 11. In this method, however, the previously-described exposure of the insulating material such as polyimide on the surface of the ion filter 1 cannot be avoided irrespective of the cutting means 70.

FIG. 9B illustrates another cutting method. According to a method of cutting from the first conductive layer 12A (or the second conductive layer 13A) as illustrated in FIG. 9B, the ion filter 1 can be cut out without exposing the material (e.g. polyimide) of the insulating substrate 11. However, the thickness of the insulating substrate 11 of the ion filter 1 is as thin as about 12.5 μm, so when the ion filter 1 is cut using a die/cutter (70), the copper foils of the first conductive layer 12A and second conductive layer 13A of the ion filter 1 are stretched when cut, and the stretched copper foils may cause a short circuit. When the cutting work is performed using laser (70), the copper foils are not stretched, but carbon generated by heat (combustion) due to the laser adheres to the side surfaces of the insulating substrate 11, and there is a risk of short circuit caused by the carbon.

When the cutting work is carried out as illustrated in FIGS. 9A and 9B, it is necessary to take into account not only the machine accuracy but also the deterioration of the working accuracy caused due to the material to be cut (ion filter 1), such as the deformation and irregularities of the material and the flatness (smoothness) at the time of working. It is thus very difficult to accurately cut out the ion filter 1 according to one or more embodiments of the present invention, which is formed with the through-holes and has a hole-area ratio of 80% at the main surface, from the substrate 10A so that the width of the frames around the ion filter 1 comes to 50 μm or less.

The manufacturing method according to one or more embodiments of the present invention includes a step of partially removing the insulating substrate 11 and a step of etching (partially removing) the conductive layers 12A and 13A, thereby to provide the ion filter 1 having the right frame RSF and left frame LSF with a width of 50 μm or less without exposing the insulating substrate (and its material such as polyimide). Moreover, the present manufacturing method achieves the dimensional accuracy at a high level such that the dimensional error is ±10 μm for the width of the right frame RSF and left frame LSF.

First, the ion filter 1 is formed on the substrate 10A. The ion filter 1 is produced using the manufacturing method as previously described with reference to FIGS. 6A to 6D.

The overview of the manufacturing method according to one or more embodiments of the present invention will be described. For the specific content, the previously-described explanation is borrowed herein. As illustrated in FIG. 6A, the substrate 10A is prepared which comprises an insulating substrate 11, a first conductive layer 12A formed on one main surface of the insulating substrate 11A, and a second conductive layer 13A formed on the other main surface of the insulating substrate 11. Thus, a so-called double-sided copper-clad laminate is prepared.

As illustrated in FIG. 6B, the second conductive layer pattern 13 having a predetermined second line width is formed through patterning a predetermined pattern such as a honeycomb design on the second conductive layer 13A using a photolithographic technique and acting an etching liquid on second predetermined regions of the second conductive layer 13A to remove the second predetermined regions. The regions removed by the etching form through-holes 30 and apertures 31 and the remaining region constitutes a rim 20 (see FIGS. 4A to 4C).

Laser irradiation is then performed.

Figure 10A:
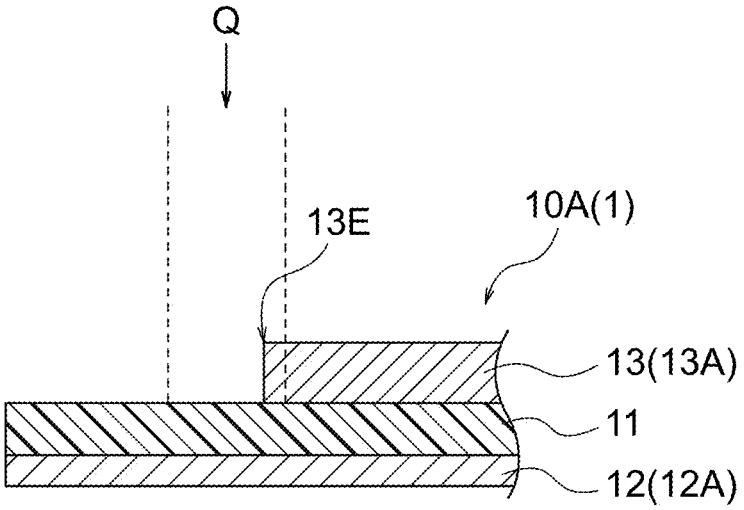
FIGS. 10A to 10C are views for describing a method of manufacturing an ion filter according to one or more embodiments of the present invention.
Figure 10B:
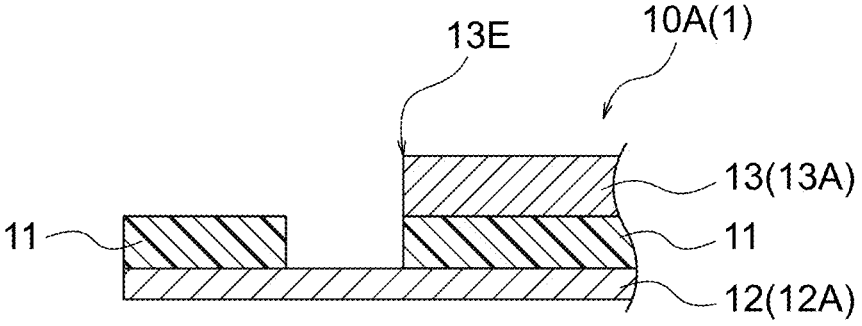

As illustrated in FIG. 10A and FIG. 6C, the intermediate product is irradiated with laser light from the other main surface side. Although the description is made with reference to different figures, in the present manufacturing method, at least two regions are irradiated with laser light. In the manufacturing method according to one or more embodiments of the present invention, (1) a formation region of the second conductive layer pattern 13 and (2) its outside region Q along the end part 13E of the second conductive layer 13A are irradiated with laser. The formation region of the second conductive layer pattern 13 and the outside region are contiguous, and the entire substrate 10A formed with the ion filter 1 may therefore be irradiated with laser. Irradiation with laser removes portions of the insulating substrate 11 corresponding to the predetermined regions. The regions removed by laser form the through-holes 30 and the apertures 31 after the subsequent steps, and the remaining region constitutes the rim 20 after the subsequent steps (see FIGS. 4A to 4C). The irradiation step with laser removes the insulating substrate 11 exposed in the outside region Q. FIG. 10B illustrates the end part of the substrate 10A after this process. This step may be performed immediately after the formation process for the second conductive layer pattern 13 or after forming the first conductive layer pattern 12, provided that the step is performed after the second conductive layer pattern 13 is formed.

Figure 10C:
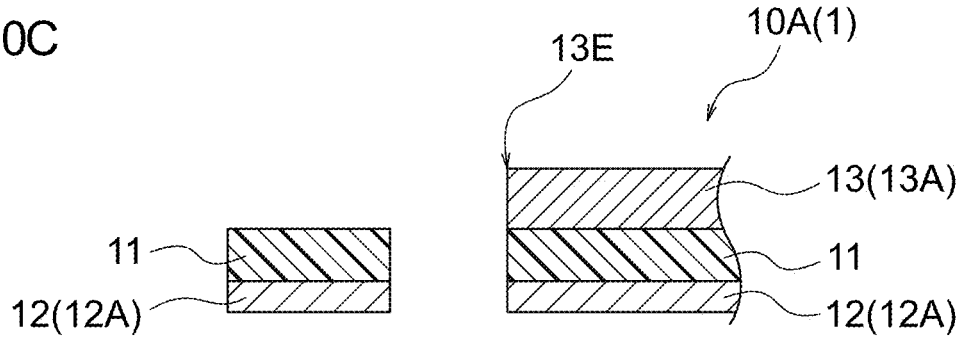

Thereafter, as illustrated in FIG. 6C, the first conductive layer pattern 12 having a predetermined first line width larger than the second line width is formed through acting an etching liquid on the first conductive layer 12A formed on the back surface side at least from the other main surface side (the second conductive layer 13A side) thereby to remove first predetermined regions. In addition to this, the first conductive layer 12A in the outside region Q of the end part 13E is removed at the end part of the substrate 10A on which the etching liquid is act. FIG. 10C illustrates the substrate 10A from which the first conductive layer 12A in the outside region Q of the end part 13E is removed.

According to the experiment conducted by the present inventor and his colleagues, the ion filter 1 was able to be obtained in which the width (thickness) of the right frame/left frame along the direction of the radius rφ is 45 μm. Moreover, in repeated experiments, the dimensional error was ±10 μm.

As described above, in the cutting step of finally cutting out the ion filter 1 from the substrate 10A, the step of partially removing the insulating substrate 11 and the step of etching (partially removing) the conductive layers 12A and 13A can be combined thereby to provide the ion filter 1 having the right frame RSF and left frame LSF with a width of 50 μm or less without exposing the insulating substrate 11 (and its material such as polyimide). From the viewpoint of the detection accuracy of the TPC 100, it is required to uniformly manufacture a plurality of ion filters 1 used for a plurality of modules. According to the manufacturing method according to one or more embodiments of the present invention, the ion filters 1 can be manufactured with the dimensional accuracy at a high level of ±10 μm (plus or minus 10 μm). Moreover, the above effects can be obtained without adding new steps because the cutting step is performed utilizing the laser radiation step and etching step in the formation step for the first and second conductive layer patterns 13 and 12 of the ion filter 1.

Although the disclosure has been described with respect to only a limited number of embodiments, those skill in the art, having benefit of this disclosure, will appreciate that various other embodiments may be devised without departing from the scope of the present invention. Accordingly, the scope of the invention should be limited only by the attached claims.

[Reference Signs List]

| | |
|---|---|
| 100 | Gas detector, TPC |
| 1 | Ion filter |
| 11 | Insulating substrate |
| 12 | First conductive layer pattern |
| 12A | First conductive layer |
| 13 | Second conductive layer pattern |
| 13A | Second conductive layer |
| 20 | Rim |
| 30 | Through-hole |
| 2 | Gas electron multiplier, Electron multiplier foil |
| 3 | Detection electrode |
| 4 | Measurement device |
| 5 | Electrode |
| CB | Chamber |
| DR | Drift region |
| E | Movement direction of electrons |

The invention claimed is:

1. An ion filter used for a gas detector that comprises a gas electron multiplier, the ion filter comprising:

an insulating substrate;

a first patterned conductive layer formed on one main surface of the insulating substrate; and a second patterned conductive layer formed on another main surface of the insulating substrate, wherein the ion filter has a plurality of through-holes formed along a thickness direction of the insulating substrate on which the first patterned conductive layer and the second patterned conductive layer are formed, the one main surface of the insulating substrate is disposed on an upstream side in a movement direction of electrons in the gas detector, the other main surface of the insulating substrate is disposed on a downstream side in the movement direction of the electrons in the gas detector, and the first patterned conductive layer has a line width thicker than a line width of the second patterned conductive layer.

2. The ion filter according to claim 1, wherein the line width of the first patterned conductive layer formed on the one main surface of the insulating substrate is 10 μm or more and 40 μm or less, and the line width of the second patterned conductive layer formed on the other main surface of the insulating substrate is 0.4 times or more and 0.9 times or less the line width of the first patterned conductive layer.

3. The ion filter according to claim 1, wherein an area of a first aperture of each of the through-holes on the first patterned conductive layer side is smaller than an area of a second aperture of each of the through-holes on the second patterned conductive layer side, and an inner surface that forms each of the through-holes on the second patterned conductive layer side has an angle of 40 degrees or more and 80 degrees or less with respect to the main surfaces of the insulating substrate.

4. The ion filter according to claim 1, wherein the ion filter is provided together with the gas electron multiplier in a side-by-side fashion, and the other main surface of the insulating substrate is disposed on the gas electron multiplier side.

5. The ion filter according to claim 1 , wherein the through-holes have a hole-area ratio of 70% or more, wherein the hole-area ratio is a ratio of a total area of apertures formed by the through-holes to a predetermined area along the main surfaces of the insulating substrate.

6. A method of manufacturing an ion filter, the method comprising:

forming a first conductive layer on one main surface of an insulating substrate and a second conductive layer on another main surface of the insulating substrate;

making an etching liquid act on a second predetermined region of the second conductive layer to remove the second predetermined region thereby to form a second patterned conductive layer having a predetermined second line width;

irradiating a formation region of the second patterned conductive layer and an outside region of an end part of the second patterned conductive layer with laser from the other main surface side; and making an etching liquid act on the first conductive layer at least from the other main surface side thereby to remove a first predetermined region to form a first patterned conductive layer having a predetermined first line width thicker than the second line width and remove the first conductive layer in the outside region of the end part.

7. The ion filter according to claim 1, wherein an electric potential of 5 to 20 V is applied between the first patterned conductive layer and the second patterned conductive layer.

8. The ion filter according to claim 1, wherein the ion filter is a positive-ion gate device that collects positive ions feeding back to a drift region to which the electrons move.

9. The ion filter according to claim 1, wherein the gas electron multiplier comprises:

an insulating substrate;

conductive layers formed on both main surfaces of the insulating substrate; and a plurality of through-holes extending in a direction approximately perpendicular to the main surfaces of the insulating substrate, and an electric potential difference of several hundred volts is applied between the conductive layers that are formed on both the main surfaces of the insulating substrate to form high electric fields inside the through-holes.

* * * * *